US008162434B2

(12) United States Patent
Chikamoto et al.

(10) Patent No.: US 8,162,434 B2
(45) Date of Patent: Apr. 24, 2012

(54) CAP AND INK-JET HEAD PROTECTION ASSEMBLY

(75) Inventors: Tadanobu Chikamoto, Nagoya (JP); Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 619 days.

(21) Appl. No.: 11/860,235

(22) Filed: Sep. 24, 2007

(65) Prior Publication Data

US 2008/0284814 A1 Nov. 20, 2008

(30) Foreign Application Priority Data

Sep. 25, 2006 (JP) ..... 2006-258420

(51) Int. Cl.
*B41J 2/165* (2006.01)

(52) U.S. Cl. ..... 347/29; 347/22; 347/23

(58) Field of Classification Search ..... 347/29, 347/22–23, 17

See application file for complete search history.

(56) References Cited

U.S. PATENT DOCUMENTS 4,684,963 A 8/1987 Naka
5,896,144 A * 4/1999 Kishimoto et al. ..... 347/30
6,068,364 A * 5/2000 Kusumi et al. ..... 347/29
6,402,288 B2 * 6/2002 Rhodes et al. ..... 347/29
7,278,710 B2 * 10/2007 Hirota et al. ..... 347/54
2006/0203032 A1 * 9/2006 Takagi ..... 347/29

FOREIGN PATENT DOCUMENTS

JP 61-211046 9/1986
JP 06-344569 12/1994
JP 07-089085 A 4/1995
JP 09-240012 9/1997

OTHER PUBLICATIONS

Notice for Reasons of Rejection: Patent Application No. 2006-258420, Mailing Date: Oct. 7, 2008.

* cited by examiner

*Primary Examiner* — Jason Uhlenhake
(74) *Attorney, Agent, or Firm* — Banner & Witcoff, Ltd.

(57) ABSTRACT

A head cap for protecting an ink ejecting face of an ink-jet head may be provided with a plate member. The plate member may be opposed to the ink ejecting face. The head cap may include a flexible, continuous lip, which projects from one surface of the plate member. Recesses may be formed in the one surface of the plate member. Through-holes may be formed through the bottom walls of the recesses, respectively. Films may further be used where each covers the associated through-hole and is joined partially to a circumferential edge portion of the associated recess.

6 Claims, 15 Drawing Sheets

CAP AND INK-JET HEAD PROTECTION ASSEMBLY

RELATED APPLICATION

This application claims priority to Japanese Application No. 2006-258420, filed Sep. 25, 2006, whose contents are expressly incorporated by reference.

BACKGROUND

1. Field

Aspects of the present invention relate to a cap and an ink-jet head protection assembly for protecting the jets during transport, for example, of an ink-jet head.

2. Description of the Related Art

Ink-jet heads that are used for ejecting ink droplets from the jets are known in which the jets are protected while they are transported or kept in storage. In one example of a recording head (ink-jet head), the recording head is kept in storage after a seal made of an acrylic adhesive is brought into close contact with the ink ejecting face and the recording head is put into a storage box made of conductive polystyrene and sealed in an aluminum pouch.

However, in this example, while the seal is kept in close contact with the ink ejecting face, the adhesive of the seal is transferred to the ink ejecting face. This may cause an event that the transferred adhesive closes or otherwise restricts the flow of the ink and, as a result, an ink ejection failure occurs when the ink-jet head is used.

One technique for protecting the jets without attaching an adhesive to the jets would be such as to use a cap which is formed with a recess and a tip portion of whose annular side wall can touch a peripheral portion of the ink ejecting face and a pressing means capable of pressing the cap against the ink ejecting face. That is, while an ink-jet head is transported, the pressing means presses the cap so that the tip portion of the annular side wall of the cap is kept in contact with the peripheral portion of the ink ejecting face. As a result, an enclosed space is formed between the ink ejecting face and the cap and the jets are protected by the cap. Since the cap and the ink ejecting face are merely in contact with each other and no adhesive or the like is used, the jets are not closed by an adhesive. The ink channels in the head are filled with a liquid (sealing liquid) for preventing deterioration of the ink ejecting characteristic during transport or storage.

SUMMARY

This summary is provided to introduce a selection of concepts in a simplified form that are further described below in the Detailed Description. This summary is not intended to identify key features or essential features of the claimed subject matter.

One or more aspects of the present invention provide an improved cap that reduces pressure differences between external air pressure and pressure inside an inkjet body. In other aspects, a cap that prevents ink leakage is described.

These and other aspects of the disclosure will be apparent upon consideration of the following detailed description of illustrative embodiments.

DETAILED DESCRIPTION

Figure 1:
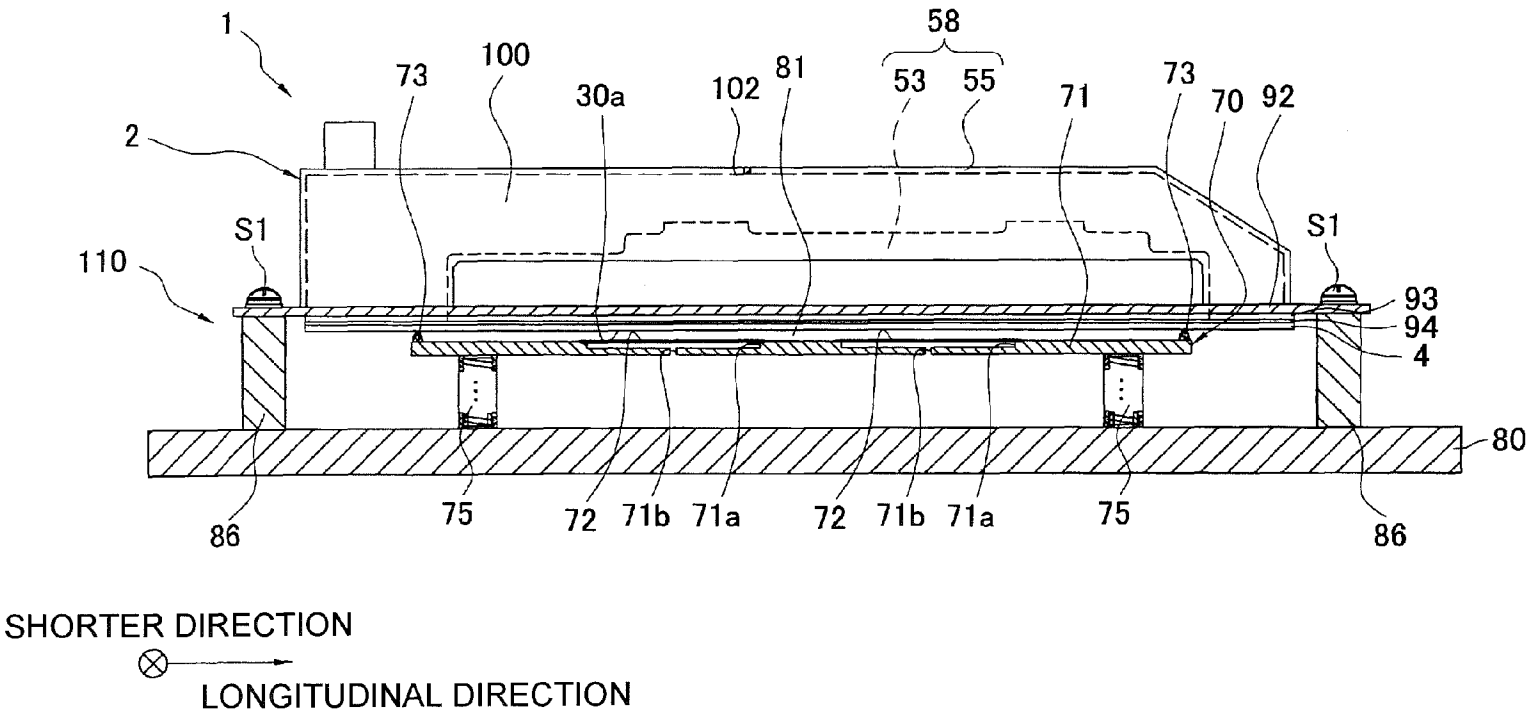
FIG. 1 schematically shows the configuration of an ink-jet head protection assembly according to a first embodiment of the present invention.

Various aspects of the present invention will be hereinafter described with reference to the drawings.

It is noted that various connections are set forth between elements in the following description. It is noted that these connections in general and, unless specified otherwise, may be direct or indirect and that this specification is not intended to be limiting in this respect.

In one example of the present invention, a cap may be used to protect an ink jet head. Here, the cap may be made of inelastic or elastic material. However, even if the annular side wall of the cap is made of an elastic material, some issues may exist. For instance, pressing the tip portion of the annular side wall against the ink ejecting face with a very strong force is not appropriate because it may scratch the ink ejecting face. For example, where an ink-jet head that is protected by a cap is transported by an airplane, the air pressure around the cap and the ink-jet head becomes lower than atmospheric pressure after a takeoff of the airplane. At this time, because of the reduction in ambient air pressure, air leaks out of the cap's enclosed space through a portion where the annular side wall contacts the ink ejecting face with lowest contact strength and the pressure within the enclosed space is thereby lowered. The pressure within the enclosed space drops more than a terrestrial (for instance) atmospheric pressure and approximately equal to the ambient air pressure. Therefore, the ink menisci in the jets do not receive pressure that exceeds their withstanding pressure (the pressure that exceeds the surface tension of the ink menisci). On the other hand, after the airplane has landed, the air pressure around the cap and the ink-jet head returns to the terrestrial atmospheric pressure (or similar atmospheric pressure). At this time, the pressure within the enclosed space does not return to atmospheric pressure quickly for the following reason. When air leaks out of the enclosed space after a takeoff, an air-leakage portion of the annular side wall is deformed so as to be curved outward. After the pressure within the enclosed space has become approximately equal to the ambient air pressure, the annular side wall contacts the ink ejecting face in a state that the air-leakage portion of annular the side wall is deformed. As a result, air is less apt to enter the enclosed space through the deformed portion. If the resulting difference between the ambient air pressure and the pressure within the enclosed space (i.e., the pressure near the ink ejecting face) exceeds the withstanding pressure of the ink menisci, the ink menisci are broken. Liquid leaks from the head into the cap and air goes into the channels.

Where part of the wall constituting an ink channel of a head is made of a flexible material such as film, the film may be bent inward (i.e., into the ink channel) as the ambient air pressure increases and returns to atmospheric pressure. This is because, as described above, the pressure within the enclosed space is kept lower than atmospheric pressure for a long time even after a landing of the airplane. If the film is bent into the ink channel, the liquid in the ink channel is pushed by the film. This produces force that causes the inks near the jets to leak into the cap. A large amount of liquid may leak into the cap.

Another example of the present invention may or may not include the structure of the above example but further includes additional pressure equalization structures or arrangements.

FIG. 1 schematically shows the configuration of an ink-jet head protection assembly according to a first embodiment of the invention. As shown in FIG. 1, the ink-jet head protection assembly 1 is composed of an ink-jet head 2 and a cap unit 110 which covers an ink ejecting face 30*a* as the bottom surface of the ink-jet head 2. The ink-jet head 2 generally has a rectangular parallelepiped shape which is long in the right-left direction in FIG. 1.

Figure 2:
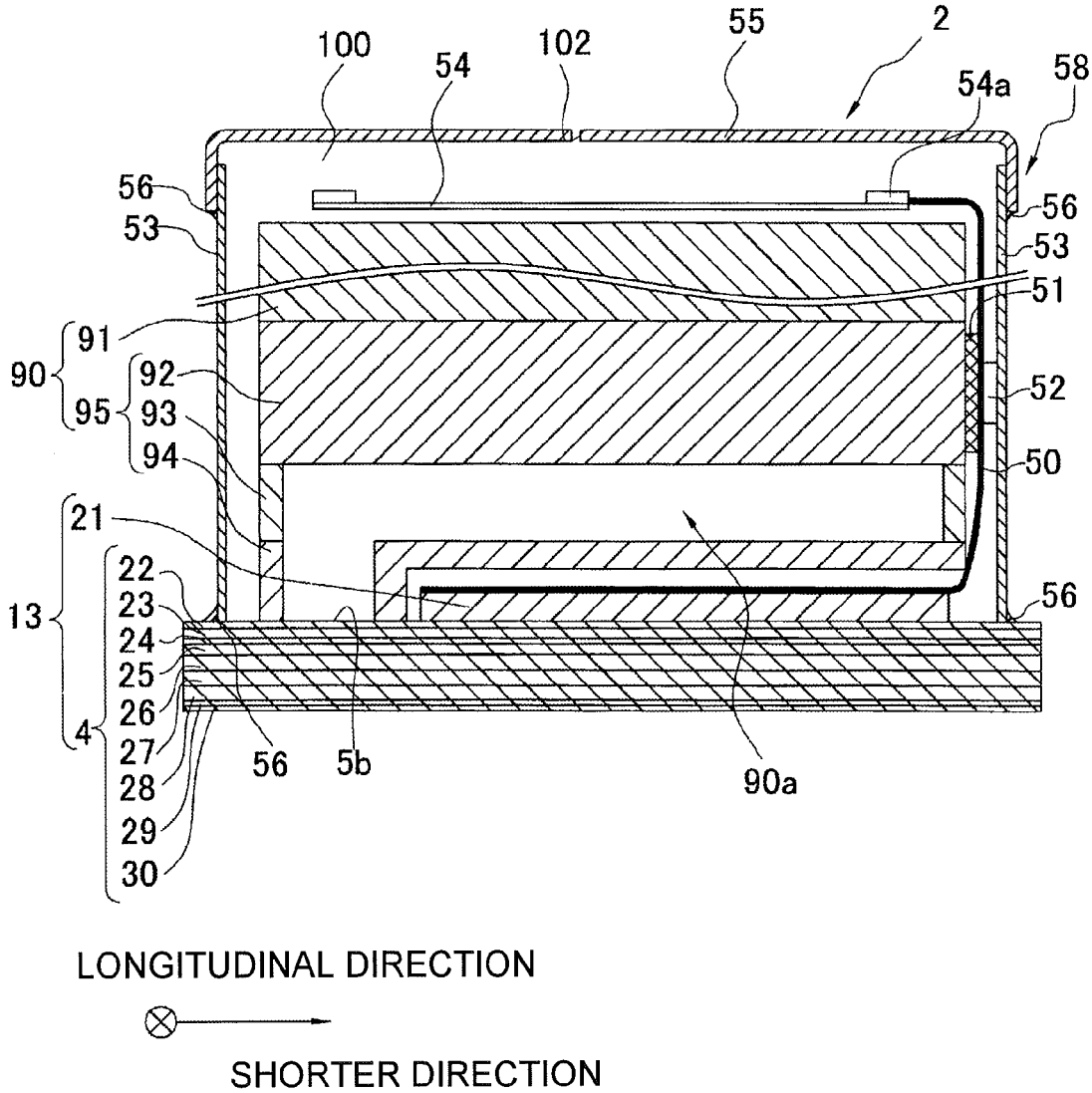
FIG. 2 is a vertical sectional view of an ink-jet head shown in FIG. 1.

Next, the configuration of the entire ink-jet head 2 will be outlined below. FIG. 2 is a vertical sectional view of the ink-jet head 2. As shown in FIG. 2, the ink-jet head 2 is provided with a head main body 13 including a channel unit 4 and a piezoelectric actuator 21, a reservoir unit 90 which is disposed on the top surface of the head main body 13 and supplies ink to the head main body 13, a flexible printed circuit board (hereinafter abbreviated as FPC) 50 which is mounted with a driver IC 52 for supplying drive signals to piezoelectric actuators 21, a control board 54 which is electrically connected to the FPC 50, the piezoelectric actuators 21, a reservoir unit 90, and a cover member 58 which covers the FPC 50 and the control board 54.

As shown in FIG. 2, the FPC 50 is electrically connected to the top surfaces of the piezoelectric actuators 21. The FPC 50 is connected to a connector 54*a* of the control board 54 which is disposed horizontally over the reservoir unit 90. Based on an instruction of the control board 54, the driver IC 52 supplies drive signals to the piezoelectric actuators 21 via a wiring (signal lines) provided on the FPC 50.

The reservoir unit 90 is disposed on the head main body 13. The reservoir unit 90 incorporates an ink reservoir 90*a* for storing ink, and the ink reservoir 90*a* communicates with ink supply holes 5*b* of the channel unit 4. Therefore, the ink in the ink reservoir 90*a* is supplied to the ink channels of the channel unit 4 via the ink supply holes 5*b*.

Composed of side covers 53 and a head cover 55, the cover member 58 is disposed so as to cover the piezoelectric actuators 21, the reservoir unit 90, the FPC 50, the control board 54, etc.

As shown in FIG. 1, each side cover 53 is a metal, plate-like member which has an approximately rectangular outward form and extends in the longitudinal direction of the channel unit 4. As shown in FIGS. 1 and 2, the two side covers 53 are disposed close to both ends, in the shorter direction of the channel unit 4, of the channel unit 4, extend parallel with the longitudinal direction of the channel unit 4 over its approximately entire length, and are fixed to the top surface of the channel unit 4. Sealing members 56 made of a silicone resin material or the like are applied to the fixing portions of the side covers 53 and the channel unit 4 from outside parallel with the longitudinal direction. The sealing members 56 not only seal the gaps between the side covers 53 and the channel unit 4 and thereby prevent ink mist etc. from entering the piezoelectric-actuator-side space through the gaps, but also fix the side covers 53 to the channel unit 4 reliably. The piezoelectric actuators 21, the reservoir unit 90, the FPC 50, and the control board 54 are disposed between the two side covers 53.

The head cover 55 is made of the same metal material as the side covers 53. The head cover 55 is disposed so as to cover top portions and both end portions, in the longitudinal direction, of the two side covers 53, and contacts the top surface of a reservoir base plate 92 (described later) of the reservoir unit 90. Sealing members 56 are applied, from outside, to the contact portions of the head cover 55 and the reservoir base plate 92 and the contact portions of the head cover 55 and the side covers 53. In this manner, an enclosed space 100 is formed by the two side covers 53 and the head cover 55. The piezoelectric actuators 21, the reservoir unit 90, the FPC 50, the control board 54, etc. are disposed in the enclosed space 100.

A through-hole (passage) 102 is formed approximately at the center of the top plate of the head cover 55. The through-hole (passage) 102 permits the pressure inside the enclosed space 100 to be equalized with the exterior air pressure. Therefore, even if the air pressure around the ink-jet head 2 varies, the pressure within the enclosed space 100 is made equal to the ambient air pressure. Various size holes may be used. Satisfactory results can be obtained where the diameter of the through-hole 102 is about 0.1-1.0 mm; in this embodiment, it is about 0.2 mm. With this dimension, the through-hole 102 allows passage of air while preventing introduction of ink mist etc. The through-hole 102 need not necessarily be formed approximately at the center of the head cover 55, and satisfactory results are obtained as long as it is formed somewhere in the head cover 55 or the side covers 53. The through-hole 102 is not limited to a single through-hole. A filter may be formed by plural through-holes each having a labyrinth structure so as to allow passage of air while preventing introduction of ink mist etc.

As shown in FIG. 2, an elastic sponge 51 is interposed between a side surface of the reservoir unit 90 and the associated side cover 53. The sponge 51 presses the driver IC 52 toward the inner surface of the side cover 53 via the FPC 50. Therefore, heat that is generated by the driver IC 52 is quickly dissipated outward from the side cover 53 and from the head cover 55 via the side cover 53. As such, the side cover 53 and the head cover 55 also function as heat radiating members.

Figure 3:
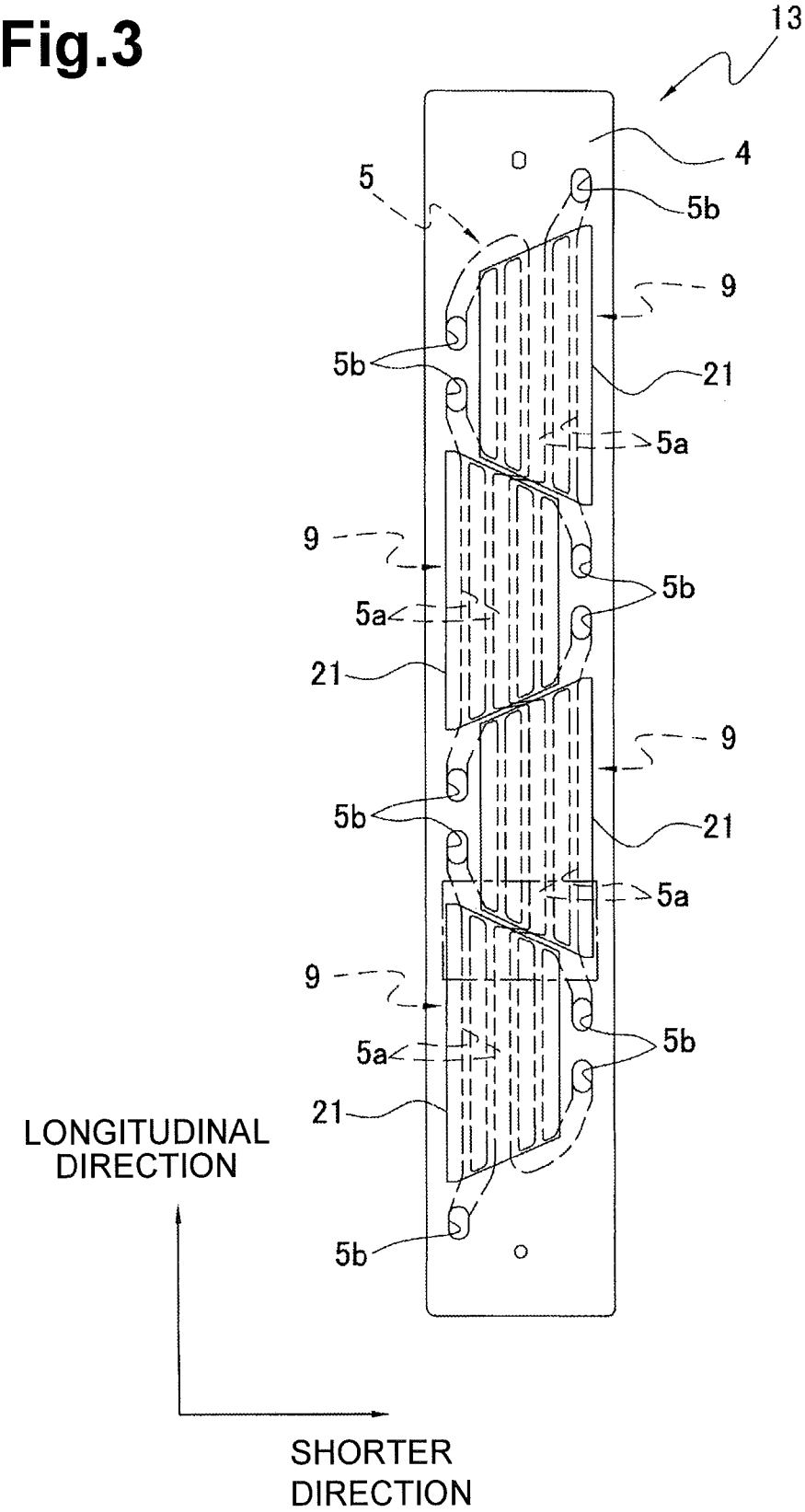
FIG. 3 is a plan view of a head main body shown in FIG. 2.
Figure 4:
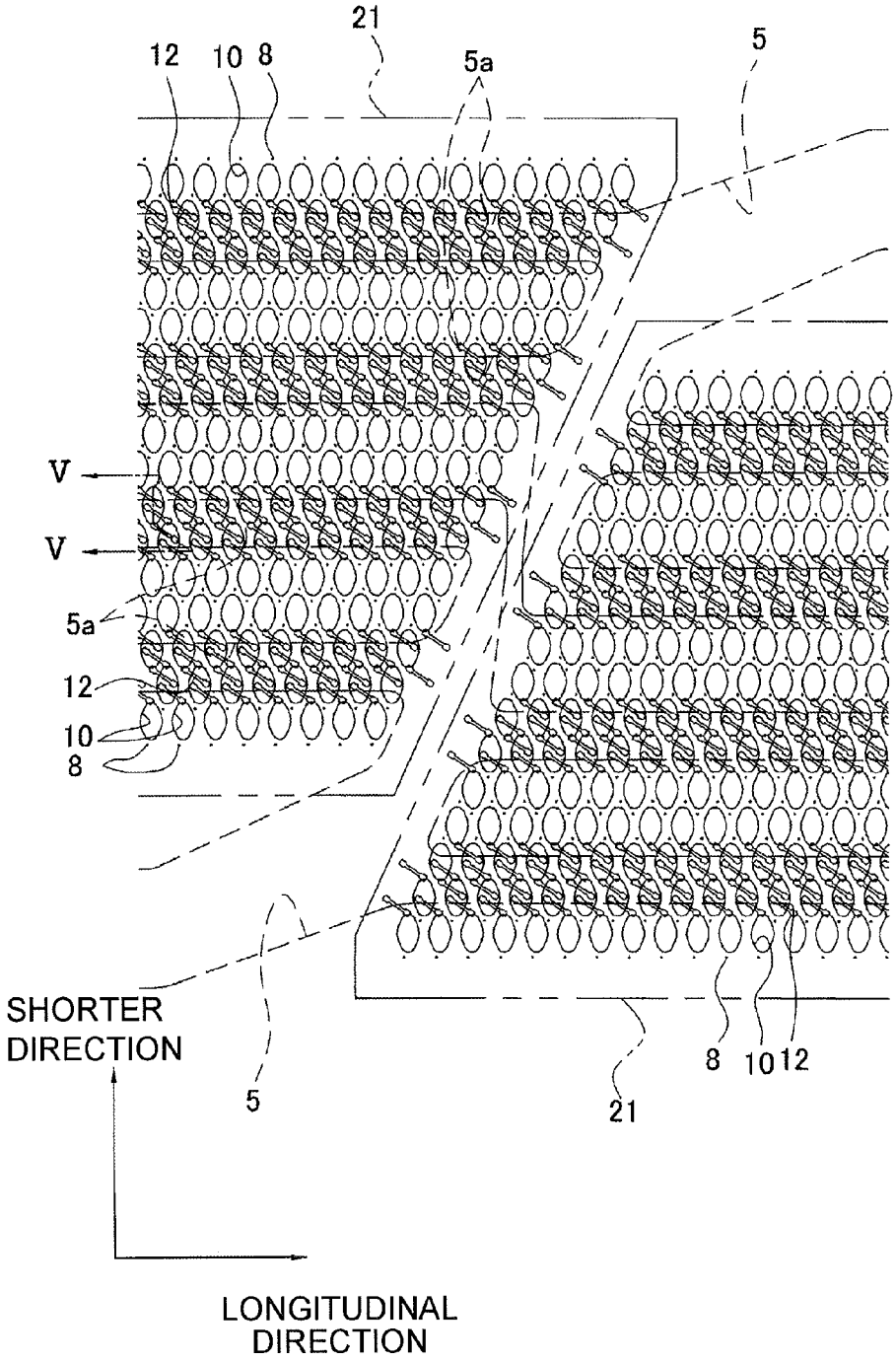
FIG. 4 is an enlarged view of a region that is enclosed by a chain line in FIG. 3.

Next, the head main body 13 will be described in detail. FIG. 3 is a plan view of the head main body 13 shown in FIG. 2. FIG. 4 is an enlarged view of a region that is enclosed by a chain line in FIG. 3. As shown in FIGS. 3 and 4, the channel unit 4 of the head main body 13 is formed with a large number of pressure rooms 10, which constitute four pressure room groups 9 as well as with a large number of nozzles 8, which communicate with the respective pressure rooms 10. Four trapezoidal piezoelectric actuators 21 are bonded to the top surface of the channel unit 4 so as to be arranged in two lines in a staggered manner.

Those regions of the bottom surface of the channel unit 4 which are opposed to the bonding regions of the piezoelectric actuators 21, respectively, are ink ejecting regions in each of which a large number of nozzles 8 are arranged. As shown in FIG. 4, in each of those regions of the top surface of the channel unit 4 which correspond to the respective ink ejecting regions, plural, generally rhombic pressure rooms 10 are arranged in two directions in matrix form. The pressure rooms 10 located in that region of the top surface of the channel unit 4, which is opposed to the bonding region of each piezoelectric actuator 21, constitute one pressure room group 9.

As shown in FIG. 4, the top surface of the channel unit 4 is formed with 16 columns of pressure rooms 10 arranged at regular intervals in the longitudinal direction of the channel unit 4. The 16 columns of pressure rooms 10 are arranged parallel with each other in the shorter direction of the channel unit 4. The number of pressure rooms 10 included in the pressure room column decreases gradually according to the outward form of the piezoelectric actuator 21, that is, as the position goes from its longer sideline to its shorter sideline. The nozzles 8 are arranged in the same manner as the pressure rooms 10.

As shown in FIGS. 3 and 4, manifold channels 5 which communicate with ink supply holes 5*b* and sub-manifold channels 5*a* which branch off the manifold channels 5 are formed in the channel unit 4. The manifold channels 5 extend along the oblique sidelines of the piezoelectric actuators 21 and cross the longitudinal direction of the channel unit 4. The sub-manifold channels 5*a* extend in the longitudinal direction of the channel unit 4 in the regions that are opposed to the trapezoidal ink ejecting regions.

As shown in FIG. 4, the large number of nozzles 8 is arranged in the longitudinal direction of the channel unit 4. Each nozzle 8 communicates with a sub-manifold channel 5*a* via the associated pressure room 10 and an associated aperture 12, which may be a narrowed channel. To facilitate understanding of FIG. 4, in FIG. 4 the piezoelectric actuators 21 are drawn by two-dot chain lines and the pressure rooms 10 and the apertures 12, which are located under the piezoelectric actuators 21 and hence should be drawn by broken lines are drawn by solid lines.

Figure 5:
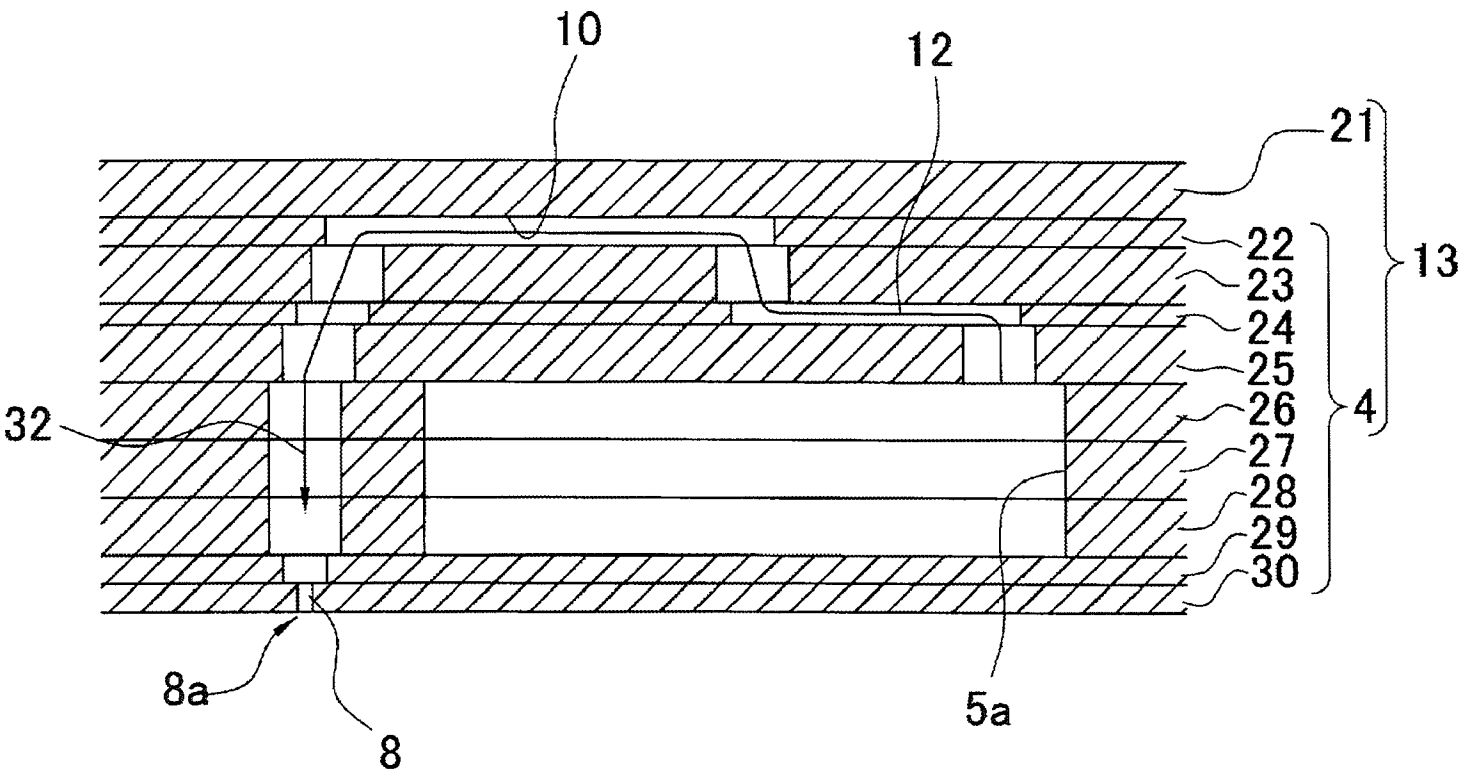
FIG. 5 is a sectional view taken along line V-V in FIG. 4.

A sectional structure of the head main body 13 will be described below. FIG. 5 is a sectional view taken along line V-V in FIG. 4. As shown in FIG. 5, the head main body 13 is formed by bonding the piezoelectric actuators 21 to the channel unit 4. The channel unit 4 has a lamination structure in which nine metal plates which are a cavity plate 22, a base plate 23, an aperture plate 24, a supply plate 25, manifold plates 26-28, a cover plate 29, and a nozzle plate 30 are laid one on another in this order from the top. An individual ink channel 32 (first channel), which extends from an exit of a sub-manifold channel 5*a* to a nozzle 8 via an aperture 12 and a pressure room 10 is formed in the channel unit 4 by means of holes that are formed in the metal plates 22-30. The piezoelectric actuators 21 are bonded to the top surface of the channel unit 4 so as to close the openings of the pressure rooms 10.

Figure 6:
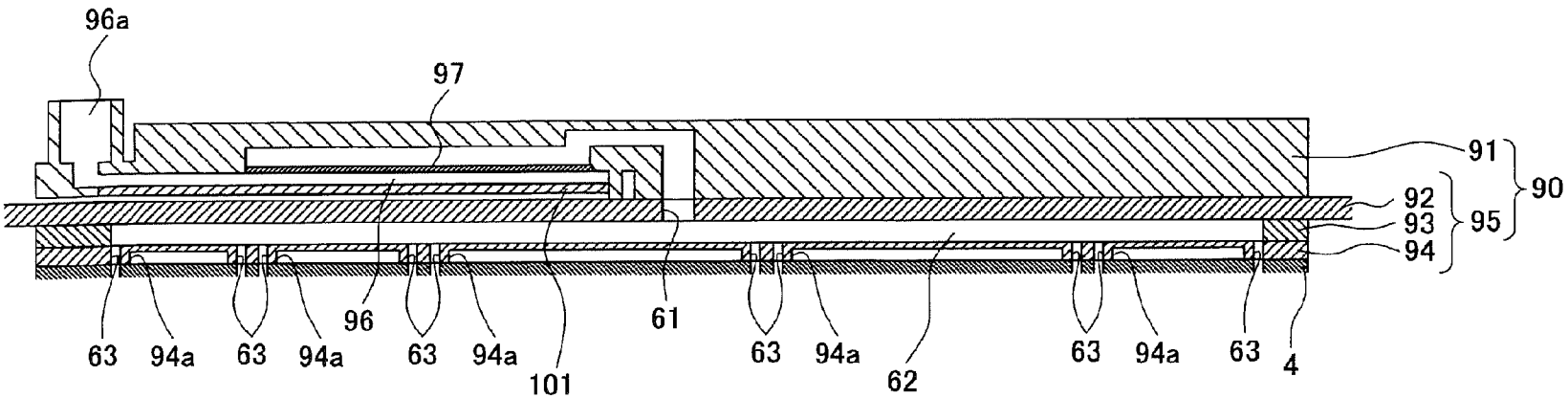
FIG. 6 is a vertical sectional view of a reservoir unit shown in FIG. 2.

Next, the reservoir unit 90 will be described. FIG. 6 is a vertical sectional view of the reservoir unit 90 shown in FIG. 2. As shown in FIGS. 2 and 6, the reservoir unit 90 is configured in such a manner that a bottom reservoir 95 which is disposed on the top surface of the channel unit 4 and a resin top reservoir 91 which is disposed on the top surface of the bottom reservoir 95 are screwed to each other. The bottom reservoir 95 is configured in such a manner that three metal plates which are a reservoir base plate 92, a reservoir plate 93, and an under plate 94 are laid one on another so as to be positioned with respect to each other. The longitudinal direction of the three plates 92-94 is the same as that of the channel unit 4. As shown in FIG. 2, the length of the three plates 92-94 in their shorter direction is shorter than the distance between the two side covers 53. As shown in FIG. 1, the length of the reservoir base plate 92 in its longitudinal direction is longer than that of the reservoir plate 93 and the under plate 94 in their longitudinal direction. That is, both end portions of the reservoir base plate 92 project outward from both ends of the reservoir plate 93, and the projecting portions are fixed to two support portions 86 (described later) with screws S1.

The reservoir base plate 92 is formed with a through-hole 61 which allows an ink channel 96 (described later) in the top reservoir 91 to communicate with an ink channel 62 (described later) formed in the reservoir plate 93. The reservoir plate 93 is formed with a hole as the ink channel 62 which communicates with the through-hole 61 and 10 through-holes 63 (described later) formed in the under plate 94. The 10 through-holes 63 are formed in the under plate 94 at such positions as to be opposed to the respective ink supply holes 5*b* in a plan view. The bottom surface of the under plate 94 is formed with recesses (thin portions) 94*a* in regions where the through-holes 63 are not formed. With this structure, when the bottom reservoir 95 is joined to the channel unit 4, spaces are formed between the channel unit 4 and the bottom reservoir 95 in the regions of the recesses 94*a*. The piezoelectric actuators 21 are put in these spaces.

The ink channel 96 (second channel) is formed in the top reservoir 91. The ink channel 96 has, at a top-left position in FIG. 6, an ink supply portion 96*a* whose top surface is opened, and ink or shipment liquid is supplied from the ink supply portion 96*a*. A damper film (flexible film) 101 is disposed at the bottom (see FIG. 6) of the top reservoir 91 so as to extend along the path of the ink channel 96. The damper film 101 serves to attenuate vibration that has been transmitted to the ink in the reservoir unit 90. The damper film 101 is provided so as to be able to be deformed into and away from the ink channel 96. Since the through-hole 102 is formed in the head cover 55, the damper film 101 can be deformed freely without being restricted by the internal pressure of the cover member 58.

A filter 97 is disposed at a halfway position in the ink channel 96 so as to be opposed to the damper film 101. Foreign particles mixed in ink that is supplied from the ink supply portion 96*a* are removed by the filter 97 and resulting ink flows into the bottom reservoir 95. In this manner, an ink reservoir 90*a* consisting of the ink channels 96 and 62 is formed in the reservoir unit 90, and ink that is supplied from the ink supply portion 96*a* is distributed to the ink supply holes 5*b* via the through-holes 63.

When the ink-jet head 2 is attached to a printer or the like and printing is performed, the ink channels of the channel unit 4 and the reservoir unit 90 are filled with ink. On the other hand, as shown in FIG. 1, in the case of the ink-jet head protection assembly 1, to protect the ink-jet head 2, these ink channels are filled with a shipment liquid containing, for example, a metal anti-corrosive agent, an anti-drying agent, and a surface active agent instead of the ink. Since the shipment liquid contains the metal anti-corrosive agent, the metal members that form the ink channels of the ink-jet head 2 are less prone to rust. Since the shipment liquid contains the anti-drying agent, it is less prone to evaporate and hence the ink channels of the ink-jet head 2 are rendered in such a state as to be protected from introduction of air or foreign particles. Furthermore, since the shipment liquid contains the anti-drying agent and the surface active agent, its surface tension is low and hence air bubbles are less prone to remain when the shipment liquid is charged into the ink channels of the ink-jet head 2. In this embodiment, the shipment liquid has a composition that is obtained by removing a colorant from the composition of the ink.

Figure 7:
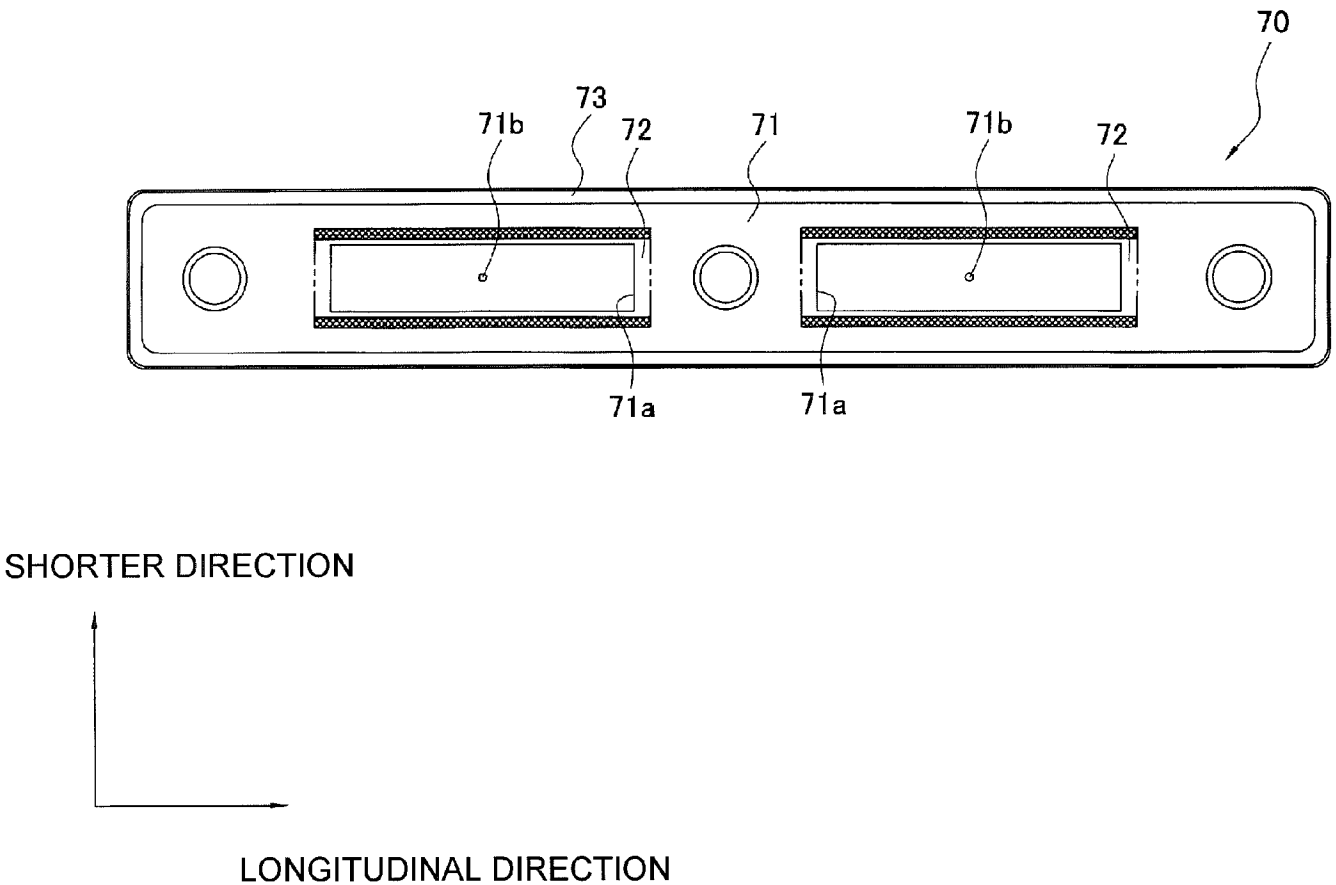
FIG. 7 is a plan view of a head cap shown in FIG. 1.

Next, the cap unit 110 will be described with reference to FIGS. 1 and 7. FIG. 7 is a plan view of a head cap 70 shown in FIG. 1. As shown in FIG. 1, the cap unit 110 is provided with a support member 80 which is long in the right-left direction in FIG. 1, two cylindrical support portions 86 which are attached to the top surface of the support member 80 at positions close to both ends in the longitudinal direction on the center line and extends upward, screws S1 which are screwed to the top portions of the support portions 86, two springs 75 whose bottom ends are fixed to the top surface of the support member 80, and the head cap (cap) 70 which is fixed to the top ends of the two springs 75. The two springs 75 are disposed so as to be equally spaced from the center of the support member 80 in its longitudinal direction so as to be fixed to at positions close to both ends of the head cap 70.

Next, the head cap 70 will be described. As shown in FIGS. 1 and 7, the head cap 70 is sandwiched between the channel unit 4 and the support member 80 via the two springs 75 and is provided with a plate member (base member) 71, two films 72 and a lip 73. As shown in FIG. 7, the plate member 71 is a flat plate which is generally rectangular in a plan view. In a state that the ink-jet head 2 is attached to the cap unit 110, the top surface (one surface) of the plate member 71 is opposed to the four ink ejecting regions of the ink ejecting face 30*a*. The top surface of the plate member 71 is formed with two recesses 71*a*, which are formed symmetrically with respect to the center line extending in the shorter direction of the plate member 71. A through-hole 71*b* penetrates through the bottom wall of each recess 71*a* of the plate member 71 approximately at the center of the recess 71*a*. The width of the opening, in the top surface of the plate member 71, of each recess 71*a* is larger than the diameter of each through-hole 71*b*.

The lip 73 is made of an elastic material (e.g., rubber) and in the top surface of the plate member 71, is disposed parallel with the outer edge (entire perimeter) of the plate member 71 in a plan view. The lip 73 is highest along its center line. When the tip of the lip 73 is brought into contact with the ink ejecting face 30*a*, a enclosed space 81 is defined by the top surface of the plate member 71, the lip 73, and the ink ejecting face 30*a*, whereby the plural jets 8*a* in the ink ejecting face 30*a* are protected.

The two films 72 are flexible and are disposed so as to cover the respective recesses 71*a*. Each film 72 is bonded to portions (hatched in FIG. 7) that are close to the longer edges of the opening of the associated recess 71*a*. On the other hand, each film 72 is not bonded to portions that are close to the shorter edges of the opening of the associated recess 71*a* and hence is free there. With this structure, when the pressure within the enclosed space 81 is made lower than the ambient pressure, because of the inside/outside pressure difference, air that flows into the recesses 71*a* through the through-holes 71*b* pushes up the films 72 toward the ink ejecting face 30*a*. Since each film 72 is bonded to only the portions of the plate member 71 that are close to the longer edges of the associated recess 71*a*, gaps are formed between the plate member 71 and the end portions, extending in the shorter direction, of the film 72. Air goes into the enclosed space 81 through those gaps, whereby the pressure within the enclosed space 81 becomes approximately equal to the ambient pressure. On the other hand, when the pressure within the enclosed space 81 is made higher than the ambient pressure, the air in the enclosed space 81 pushes down the films 72 in an attempt to go out through the through-holes 71*b*. The portions of the plate member 71 to which the films 72 are not bonded are sealed by the films 72, and hence the air does not flow out of the enclosed space 81. However, since the films 72 are deformed, the capacity of the enclosed space 81 is increased and the difference between the pressure within the enclosed space 81 and the pressure of the outside environment is reduced. In this manner, each set of a through-hole 71*b* and a film 72 whose end portions extending in the longitudinal direction are the only portions bonded to the plate member 71 constitute a check valve.

Next, a method for protecting the ink-jet head 2 by means of the cap unit 110 will be described.

First, the ink-jet head 2 is prepared. In the ink-jet head 2, a valve is fixed to the ink supply portion 96*a* and the channels can be opened or closed with the valve. The shipment liquid is charged into the ink-jet head 2 via the valve to establish a state that air and foreign particles have flown into the channels. The valve is kept closed after the shipment liquid is charged in the ink-jet head 2, which prevents introduction of air or foreign particles through the ink supply portion 96*a* as well as leakage of the shipment liquid. Then, both end portions of the reservoir base plate 92 are fixed to the support member 86 with the screws S1, whereby the ink-jet head 2 is attached to the cap unit 110 as shown in FIG. 1. At this time, the plate member 71 is urged toward the ink ejecting face 30*a* by the two springs 75. As a result, the lip 73 is brought into contact with the ink ejecting face 30*a* so as to surround all the jets 8*a* and a enclosed space 81 is formed. The ink-jet head 2 is thus protected.

Figures 8A, 8B, 8C:
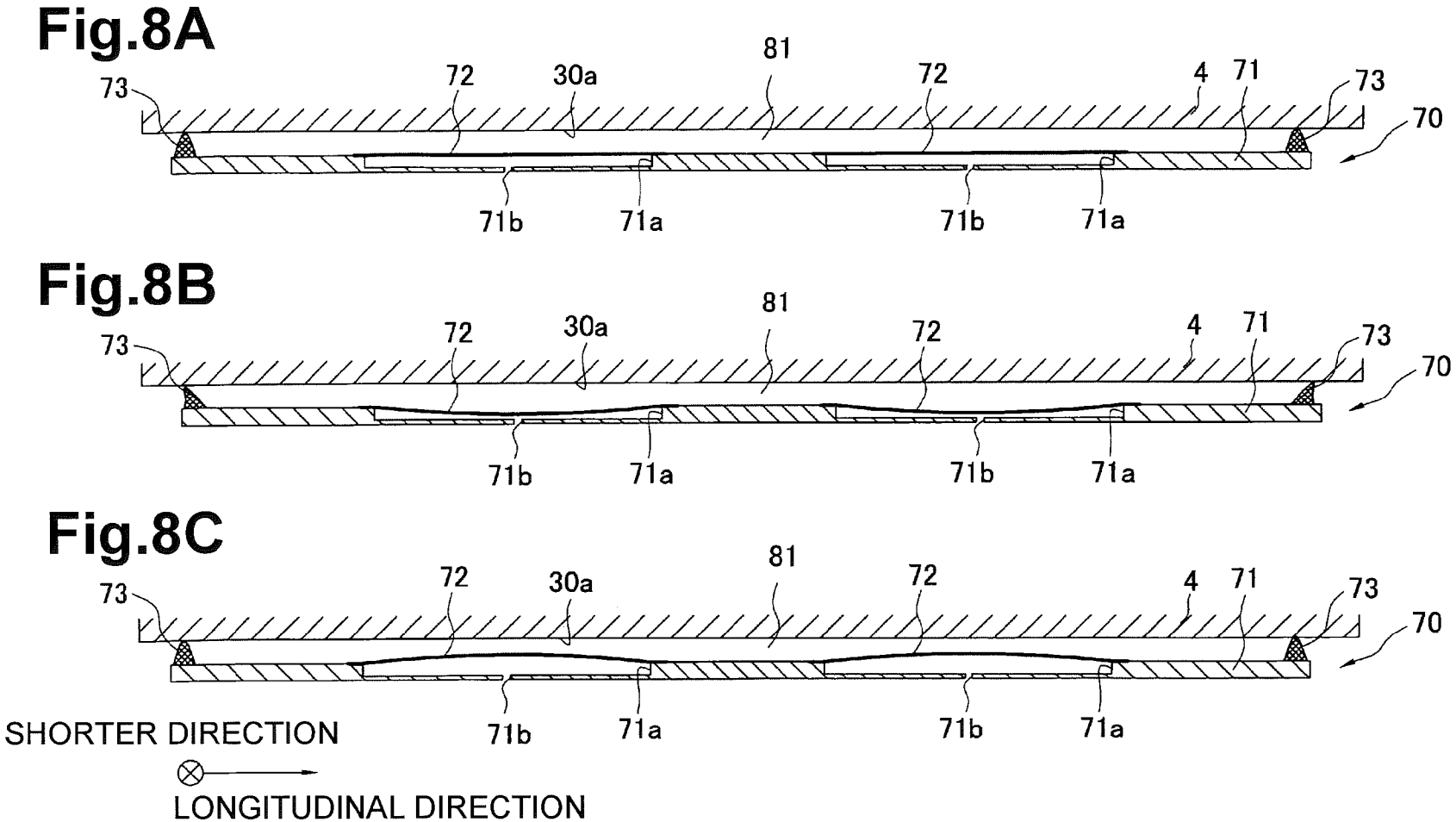
FIGS. 8A-8C show how the head cap operates when a variation occurs in ambient air pressure in a state that an ink ejecting face is protected by the head cap according to the first embodiment of the invention.

Operations that are performed by the head cap 70 when an air pressure variation occurs in a state that the ink-jet head 2 is protected (transport state) will be described with reference to FIGS. 8A-8C. FIGS. 8A-8C show how the head cap 70 operates when a variation occurs in ambient air pressure in a state that the ink ejecting face 30*a* is protected by the head cap 70.

As shown in FIG. 8A, in a state that the ink ejecting face 30*a* is protected by the head cap 70, usually the pressure within the enclosed space 81 is the same as the ambient air pressure and hence the films 72 are not curved and kept parallel with the ink-ejecting face 30*a*.

A description will be made of a case that the ink-jet head protection assembly 1 is transported by an airplane. After the airplane has taken off, a high-altitude air pressure is low and the pressure within the enclosed space 100 decreases so as to become approximately equal to the ambient air pressure due to passage of air through the through-hole 102 of the cover member 58. At this time, since the pressure within the enclosed space 81 exceeds the ambient air pressure by more than 40 kPa (first prescribed value), for example, as shown in FIG. 8B the films 72 are deformed (curved) into the recesses 71*a*. As a result, the capacity of the enclosed space 81 is increased and the difference between the pressure within the enclosed space 81 and the pressure of the outside environment is reduced. If the inside/outside pressure difference is even larger, a portion of the lip 73 that contacts the ink ejecting face 30*a* with lowest contact strength is deformed so as to fall outward. Air leaks out of the enclosed space 81 through the collapsed portion of the lip 73, whereby the pressure within the enclosed space 81 is decreased and becomes approximately equal to the ambient air pressure. In this manner, the pressure within the enclosed space 100 is kept approximately equal to that of the enclosed space 81. Therefore, the damper film 101 is not curved outward (i.e., away from the ink channel 96) and the ink menisci formed in the jets 8*a* do not receive pressure that exceeds their withstanding pressure. This prevents air bubbles from entering the channels via the ink ejecting face 30*a* (through nozzles 8).

When the pressure within the enclosed space 81 becomes approximately equal to the ambient air pressure, the collapsed portion of the lip 73 is brought into contact with the ink ejecting face 30*a* in a state that it is kept deformed, to effect sealing. The films 72 return to a state that they are approximately parallel with the ink ejecting face 30*a*.

On the other hand, after the airplane has landed, the ambient air pressure returns to atmospheric pressure from a low pressure and the pressure within the enclosed space 100 likewise returns to the original value. Since the pressure within the enclosed space 81 is lower than atmospheric pressure by more than 40 kPa (second prescribed value), for example, as shown in FIG. 8C the films 72 are deformed (expanded) toward the ink ejecting face 30*a*. At this time, the enclosed space 81 communicates with the outside environment via the through-holes 71*b* and the gaps between the plate member 71 and the non-bonded portions (i.e., the end portions extending in the shorter direction) of the films 72. Therefore, the pressure within the enclosed space 81 returns quickly from the low value to the original value. Since the pressure within the enclosed space 100 becomes approximately equal to the pressure within the enclosed space 81, the damper film 101 is not curved inward (i.e., into the ink channel 96) and the ink menisci formed in the jets 8*a* do not receive pressure that exceeds their withstanding pressure. The ink menisci are not broken and the shipment liquid does not leak into the enclosed space 81.

As described above, since only the portions of the films 72 are bonded to the plate member 71, gas does not flow out of the enclosed space 81 whereas ambient gas can flow into the enclosed space 81 through the through-holes 71*b*. The films 72 are configured so as to be deformed (curved) easily due to an inside/outside pressure difference. Since the check valves which have the above-described simple structure and exhibit a damper effect are formed, the configuration of the head cap 70 is simple.

The top surface of the plate member 71 is formed with the recesses 71*a*, and the films 72 are disposed so as to cover the respective recesses 71*a*. Therefore, even if the temperature of the enclosed space 81 is increased and the gas therein is thereby expanded, the damper effect allows the films 72 to be bent into the recesses 71*a*. Therefore, although the air in the enclosed space 81 is forced to expand to increase the pressure, the pressure increase is absorbed by bending of the films 72 and almost no variation occurs in the pressure within the enclosed space 81. If the air in the enclosed space 81 is further forced to expand, a portion of the lip 73 falls outward and the inside/outside pressure difference is adjusted. Since no difference occurs between the pressure within the enclosed space 100 and the pressure within the enclosed space 81, the ink menisci in the jets 8*a* can be prevented from being broken. Therefore, the air in the enclosed space 81 is not prone to enter the ink jet head 2 through jets 8*a*.

Since the enclosed space 81 is rendered open to the outside only temporarily due to an inside/output pressure difference, the shipment liquid is hardly evaporated via the ink ejecting face 30*a*. Therefore, the ink-jet head 2 is kept in good conditions and can exercise desired ink ejecting characteristics reliably. As described above, in the ink-jet head protection assembly 1 according to this embodiment, when the ambient pressure becomes low, the pressure within the enclosed space 100 decreases so as to become approximately equal to the ambient air pressure. At this time, if the pressure within the enclosed space 81 becomes higher than the ambient air pressure by more than a prescribed value, the lip 73 is deformed and gas flows out of the enclosed space 81, whereby the pressure within the enclosed space 81 approaches the ambient air pressure. The plate member 71 is provided with the check valves which are opened when the ambient air pressure becomes higher than the air pressure within the enclosed space 81 by more than a prescribed value. Therefore, when the ambient pressure is increased, external air flows into the enclosed space 81 via the check valves and the pressure within the enclosed space 81 approaches the ambient air pressure. And also, the pressure within the enclosed space 100 approaches the ambient air pressure. That is, since no difference occurs between the pressure within the enclosed space 100 and the pressure within the enclosed space 81, the damper film 101 is not curved with respect to the ink channel 96 and the ink menisci in the jets 8*a* do not receive high pressure. Therefore, even if the ambient air pressure becomes higher than the pressure within the enclosed space 81, ink does not leak through jets 8*a*. Conversely, even if the ambient air pressure becomes low, no air bubbles enter the channels through jets 8*a* and ink does not leak through jets 8*a*.

Figure 9:
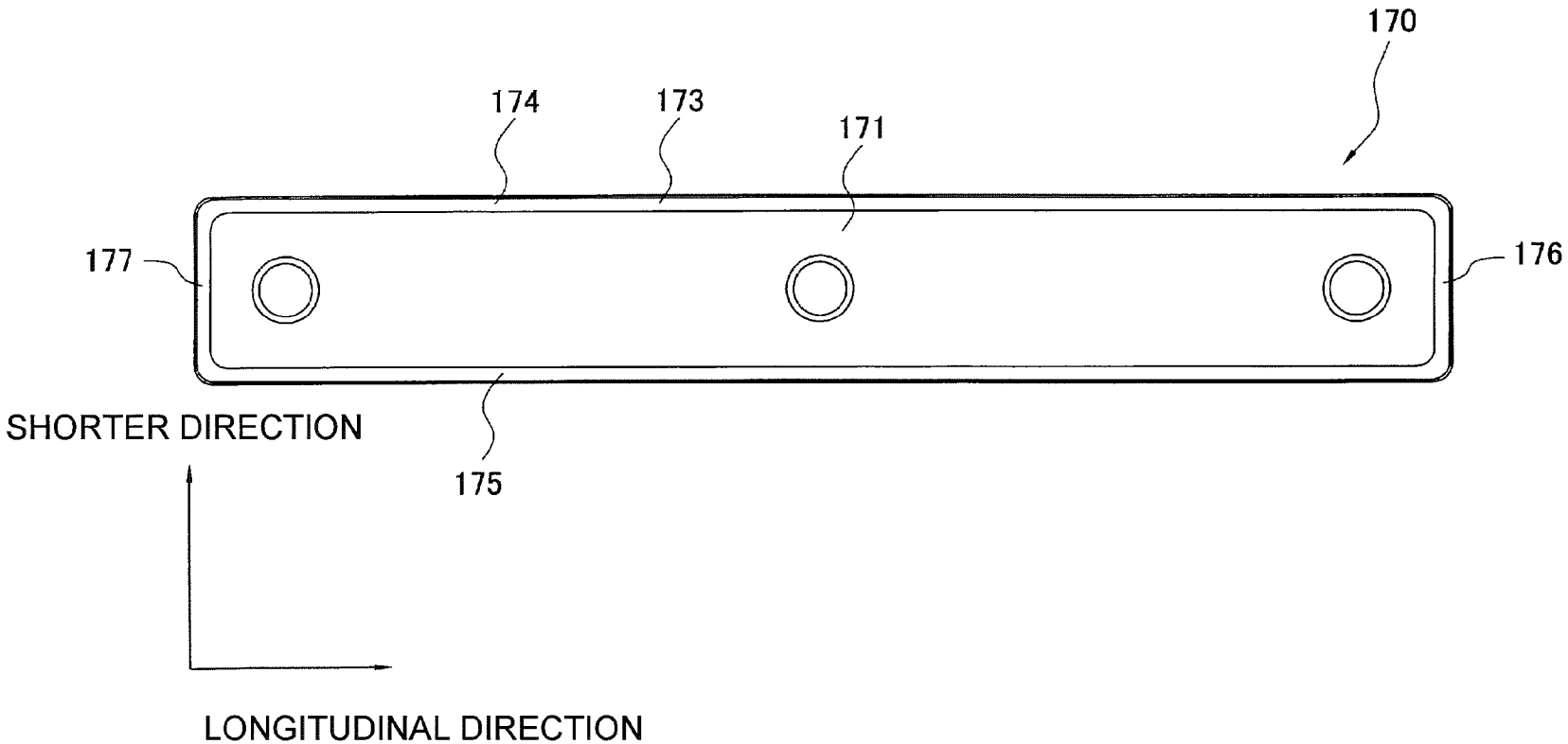
FIG. 9 is a plan view of a head cap according to a second embodiment of the invention.
Figure 10:
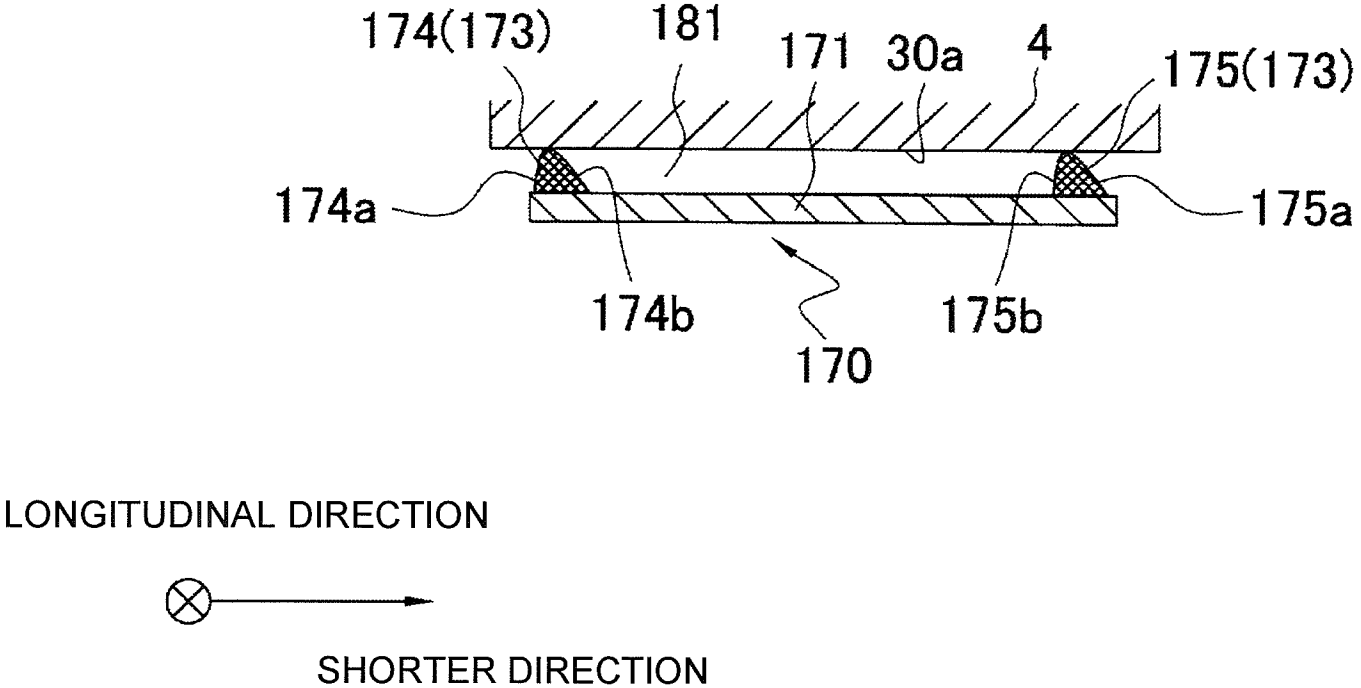
FIG. 10 shows how the ink ejecting face is protected by the head cap of FIG. 9.

Next, an ink-jet head protection assembly according to a second embodiment of the invention will be described with reference to FIGS. 9 and 10. FIG. 9 is a plan view of a head cap 170. FIG. 10 shows how the ink ejecting face 30*a* is protected by the head cap 170. This embodiment is the same as the first embodiment except that a lip 173 and a plate member 171 are a little different in structure from the lip 73 and the plate member 71 of the first embodiment. Therefore, members etc. having the same ones in the first embodiment will be given the same reference symbols as the latter and will not be described.

As shown in FIG. 9, the head cap 170 is made of the plate member (base member) 171 and the lip 173. The plate member 171 is a flat plate which is generally rectangular in a plan view. The top surface (one surface) of the plate member 171 is opposed to the regions of the ink ejecting face 30*a* where the plural jets 8*a* are formed.

The lip 173 is made of an elastic material (e.g., rubber) and is provided with two longer portions 174 and 175 which extend in the longitudinal direction of the plate member 171 and two shorter portions 176 and 177 which extend in the shorter direction of the plate member 171. The two longer portions 174 and 175 and the two shorter portions 176 and 177 are continuous with each other and are disposed on the top surface of the plate member 171 parallel with its outer edge (entire perimeter). When the tips of the two longer portions 174 and 175 and the two shorter portions 176 and 177 are brought in contact with the ink ejecting face 30*a*, an enclosed space 181 is defined by the top surface of the plate member 171, the lip 173, and the ink ejecting face 30*a*. The ink ejecting face 30*a* is thus protected.

Next, the two longer portions 174 and 175 and the two shorter portions 176 and 177 will be described in detail with reference to FIGS. 9 and 10. As shown in FIG. 10, the longer portion 174 (first portion) is disposed on the plate member 171 at a left-hand position (as seen in FIG. 10). In the tip portion of the longer portion 174, the angle formed by the outer side surface 174*a* of the longer portion 174 and the perpendicular to the top surface of the plate member 171 is smaller than the angle formed by the inner side surface 174*b* of the longer portion 174 and the perpendicular. With this structure, when the longer portion 174 touches the ink ejecting face 30*a*, the inner side surface 174*b* of the longer portion 174 is brought into contact with the ink ejecting face 30*a*. Therefore, the longer portion 174 tends to fall in the direction from the inner side surface 174*b* to the outer side surface 174*a*.

As shown in FIG. 10, the longer portion 175 (second portion) is disposed on the plate member 171 at a right-hand position (as seen in FIG. 10). In the tip portion of the longer portion 175, the angle formed by the outer side surface 175*a* of the longer portion 175 and the perpendicular to the top surface of the plate member 171 is larger than the angle formed by the inner side surface 175*b* of the longer portion 175 and the perpendicular. With this structure, when the longer portion 175 touches the ink ejecting face 30*a*, the outer side surface 175*a* of the longer portion 175 is brought into contact with the ink ejecting face 30*a*. Therefore, the longer portion 175 tends to fall in the direction from the outer side surface 175*a* to the inner side surface 175*b*.

As shown in FIG. 9, the two shorter portions 176 and 177 are disposed on the plate member 171 at the right and left ends (as seen in FIG. 9). In the tip portions of the two shorter portions 176 and 177, the angle formed by each of the outer side surfaces of the two shorter portions 176 and 177 and the perpendicular to the top surface of the plate member 171 is equal to the angle formed by each of the inner side surfaces of the two shorter portions 176 and 177 and the perpendicular. That is, as for the two shorter portions 176 and 177, the easiness to fall (or rigidity) in the direction from the inner side surface to the outer side surface is the same as that in the direction from the outer side surface to the inner side surface. The easiness to fall of each of the two shorter portions 176 and 177 in the direction from the inner side surface to the outer side surface (or from the outer side surface to the inner surface) exceeds that of the longer portion 174 in the direction from the outer side surface 174*a* to the inner side surface 174*b* and that of the longer portion 175 in the direction from the inner side surface 175*b* to the outer side surface 175*a*, and lower than that of the longer portion 174 in the direction from the inner side surface 174*b* to the outer side surface 174*a* and that of the longer portion 175 in the direction from the outer side surface 175*a* to the inner side surface 175*b*.

Now, as in the description of the first embodiment, operations that are performed by the head cap 170 when an air pressure variation occurs in a state that the ink-jet head 2 is protected (transport state) will be described with reference to FIG. 10.

A description will be made of a case that the ink-jet head protection assembly 1 is transported by an airplane. After the airplane has taken off, a high-altitude air pressure is low and the pressure within the enclosed space 100 decreases so as to become approximately equal to the ambient air pressure due to passage of air through the through-hole 102 of the cover member 58. At this time, since the pressure within the enclosed space 181 exceeds the ambient air pressure by more than 40 kPa (first prescribed value), for example, a portion of the longer portion 174 that contacts the ink ejecting face 30*a* and the lip 173 with lowest contact strength is deformed so as to fall outward. Air leaks out of the enclosed space 181 through the collapsed portion of the longer portion 174, whereby the pressure within the enclosed space 181 is decreased and becomes approximately equal to the ambient air pressure. On the other hand, the longer portion 175 and the two shorter portions 176 and 177 are less apt to fall outward than the longer portion 174, they are kept in contact with the ink ejecting face 30*a*. In this manner, the pressure within the enclosed space 100 is kept approximately equal to that in the enclosed space 181. Therefore, the damper film 101 is not curved outward (i.e., away from the ink channel 96) and the ink menisci formed in the jets 8*a* do not receive pressure that exceeds their withstanding pressure. This prevents air bubbles from entering the channels. When the pressure within the enclosed space 181 becomes approximately equal to the ambient air pressure, the collapsed portion of the longer portion 174 automatically restores its original shape and the entire tip portion of the lip 173 is brought into contact with the ink ejecting face 30*a*, to effect sealing.

As described above, since the rigidity of the longer portion 174 in the direction from the inner side surface 174*b* to the outer side surface 174*a* is lower than in the direction from the outer side surface 174*a* to the inner side surface 174*b*, the longer portion 174 falls in the direction from the inner side surface 174*b* to the outer side surface 174*a* when the ambient air pressure is lower than the pressure within the enclosed space 181. At this time, the longer portion 174 is partially separated from the ink ejecting face 30*a*, whereby the enclosed space 181 communicates with the outside environment. This allows air to flow out of the enclosed space 181 reliably.

On the other hand, after the airplane has landed, the ambient air pressure returns to atmospheric pressure from a low pressure and the pressure within the enclosed space 100 likewise returns to the original value. Since the pressure within the enclosed space 181 is lower than atmospheric pressure by more than 40 kPa (second prescribed value), for example, a portion of the longer portion 175 that contacts the ink ejecting face 30*a* and lip 173 with lowest contact strength is deformed so as to fall inward. External air flows into the enclosed space 181 through the collapsed portion of the longer portion 175, whereby the pressure within the enclosed space 181 returns from the low value to the original value. On the other hand, the longer portion 174 and the two shorter portions 176 and 177 are less apt to fall inward than the longer portion 175, they are kept in contact with the ink ejecting face 30*a*. Since the pressure within the enclosed space 100 becomes approximately equal to the pressure within the enclosed space 181, the damper film 101 is not curved inward (i.e., into the ink channel 96) and the ink menisci formed in the jets 8*a* do not receive pressure that exceeds their withstanding pressure. The ink menisci are not broken and the shipment liquid does not leak into the enclosed space 181. When the pressure within the enclosed space 181 becomes approximately equal to the ambient air pressure, the collapsed portion of the longer portion 175 automatically restores its original shape and the entire tip portion of the lip 173 is brought into contact with the ink ejecting face 30*a*, to effect sealing.

As described above, since the rigidity of the longer portion 175 in the direction from the outer side surface 175*a* to the inner side surface 175*b* is lower than in the direction from the inner side surface 175*b* to the outer side surface 175*a*, the longer portion 175 falls in the direction from the outer side surface 175*a* to the inner side surface 175*b* when the ambient air pressure exceeds the pressure within the enclosed space 181. At this time, the longer portion 175 is partially separated from the ink ejecting face 30*a*, whereby the enclosed space 181 communicates with the outside environment. This allows external air to flow into the enclosed space 181 reliably.

As described above, in the ink-jet head protection assembly 1 according to this embodiment, when the ambient pressure becomes low, the pressure within the enclosed space 100 decreases together with the ambient air pressure. At this time, if the pressure within the enclosed space 181 becomes higher than the ambient air pressure by more than the prescribed value, the longer portion 174 is deformed and air flows out of the enclosed space 181, whereby the pressure within the enclosed space 181 approaches the ambient air pressure. Conversely, even when the pressure within the enclosed space 181 has decreased, if the pressure within the ambient air pressure becomes higher than the pressure within the enclosed space 181 by more than the prescribed value, the longer portion 175 is deformed, whereby external air flows into the enclosed space 181 and the pressure within the enclosed space 181 approaches the ambient air pressure. At this time, the pressure within the enclosed space 100 increases together with the ambient air pressure. Since no difference occurs between the pressure within the enclosed space 100 and the pressure within the enclosed space 181, the damper film 101 is not curved with respect to the ink channel 96 and the ink menisci in the jets 8*a* do not receive high pressure. Therefore, even if the ambient air pressure becomes higher than the pressure within the enclosed space 181, ink does not leak through jets 8*a*. Conversely, even if the ambient air pressure becomes low, no air bubbles enter the channels through jets 8*a*.

If portions of the lip 173 where the inner side surface or the outer side surface is to touch the ink ejecting face 30*a* were formed at the corners, it would be difficult to bend the lip 173. That is, the lip 173 can be formed more easily by forming it so that the inner side surface 174*b* of the longer portion 174 and the outer side surface 175*a* of the longer portion 175 are to touch the ink ejecting face 30*a*.

Figure 11:
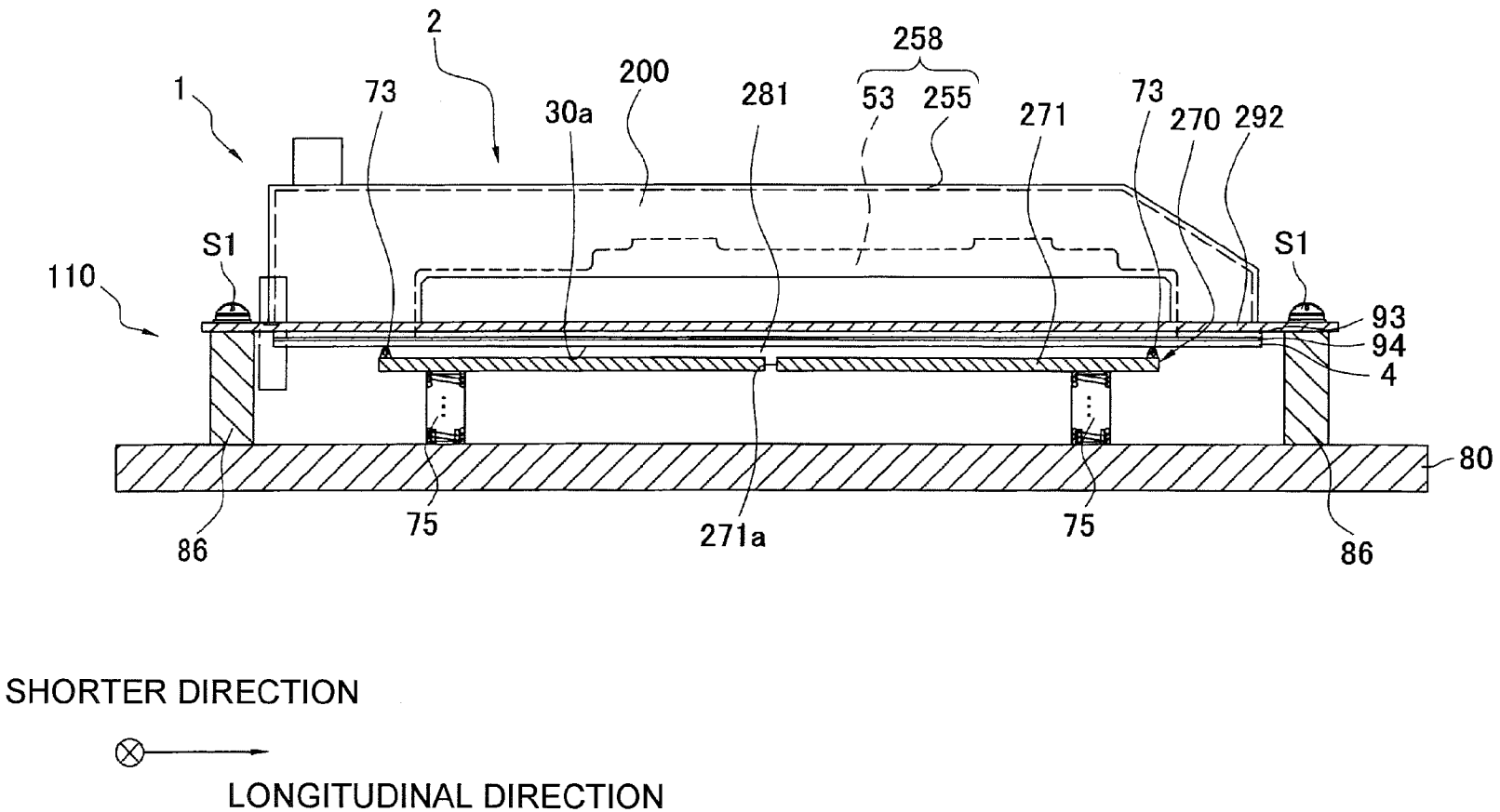
FIG. 11 schematically shows the configuration of an ink-jet head protection assembly according to a third embodiment of the invention.
Figure 12:
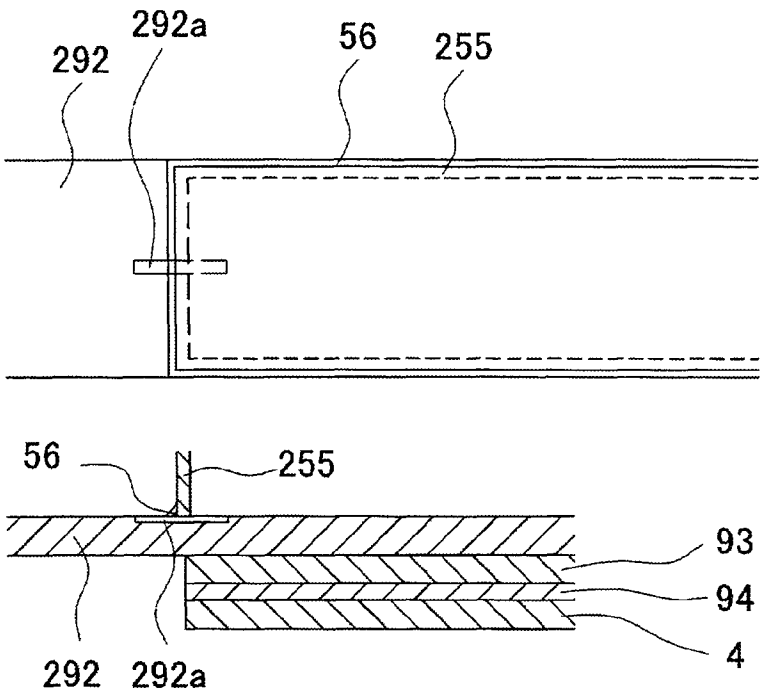
FIG. 12 is a plan view and an enlarged view of a region that is enclosed by a chain line in FIG. 11.
Figure 13:
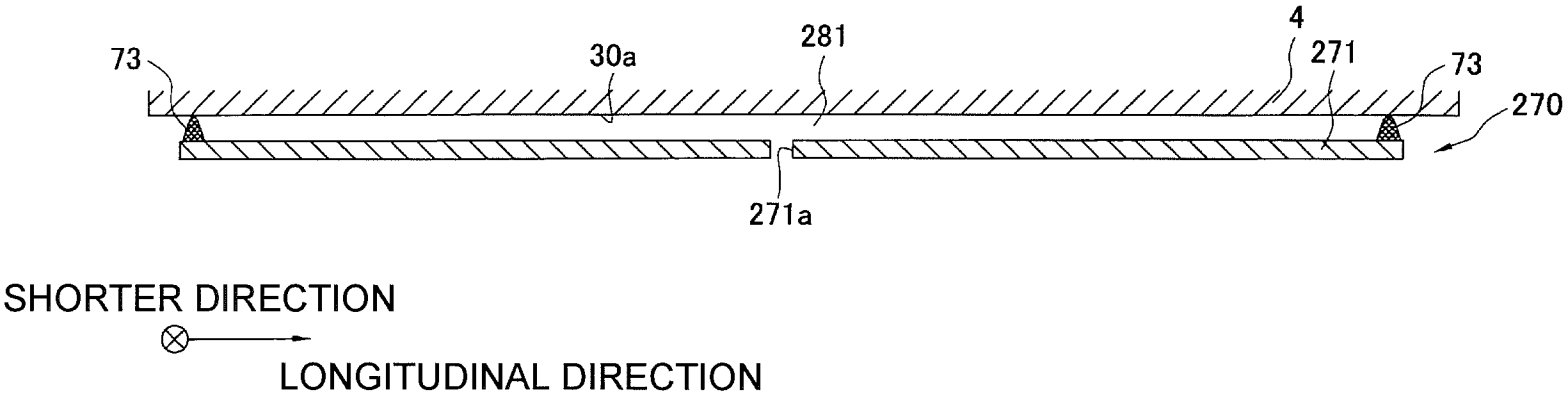
FIG. 13 is a sectional view of a head cap shown in FIG. 11.

Next, an ink-jet head protection assembly according to a third embodiment of the invention will be described with reference to FIGS. 11-13. FIG. 11 schematically shows the configuration of an ink-jet head protection assembly according to the third embodiment of the invention. FIG. 12 is a plan view and an enlarged view of a region that is enclosed by a chain line in FIG. 11. FIG. 13 is a sectional view of a head cap 270 shown in FIG. 11. This embodiment is the same as the first embodiment except that a plate member 271, a cover member 258, and a reservoir base plate 292 are a little different in structure from the plate member 71, the cover member 58, and the reservoir base plate 92 of the first embodiment. Therefore, members etc. having the same ones in the first embodiment will be given the same reference symbols as the latter and will not be described.

The cover member 258 is composed of side covers 53 and a head cover 255. The through-hole 102 that is formed in the head cover 55 in the first embodiment is not formed in the head cover 255. A enclosed space 200 is defined by the two side covers 53 and the head cover 255. A sealing member 56 is applied, over the approximately entire length, to the portion where the cover member 258 contacts the reservoir base plate 292.

As shown in FIG. 12, the top surface of the reservoir base plate 292 is formed with a recess 292*a* approximately at the center in the shorter direction in such a manner that it extends in the longitudinal direction and crosses the left-hand contact portion (as seen in FIG. 11) of the head cover 255 and the reservoir base plate 292 so that the enclosed space 200 communicates with the outside environment. With this approach, the pressure within the enclosed space 200 varies in link with the ambient air pressure.

As shown in FIG. 13, the head cap 270 is provided with a plate member 271 and a lip 73. As shown in FIG. 13, the plate member 271 is a flat plate which is generally rectangular in a plan view. In a state that the ink-jet head 2 is attached to a cap unit 110, the top surface (one surface) of the plate member 271 is opposed to the regions of the ink ejecting face 30*a* where the plural jets 8*a* are formed. A through-hole (passage) 271*a* penetrates through the plate member 271 approximately at the center. The through-hole 271*a* is a slit of about 0.1 mm in width. In this embodiment, the slit length is set at 3 mm. When the tip of the lip 73 is brought in contact with the ink ejecting face 30*a*, a enclosed space 281 is defined by the top surface of the plate member 271, the lip 73, and the ink ejecting face 30*a*, whereby the plural jets 8*a* in the ink ejecting face 30*a* are protected. It is preferable that the slit width of the through-hole 271*a* be in a range of 0.05 to 0.5 mm. As long as the slit width falls within this range, the head cap 270 allows the humidity of the enclosed space 281 to be kept in a proper range and hence ink is not prone to start drying from the ink ejecting face 30*a*. On the other hand, if the slit width of the through-hole 271*a* is greater than 0.5 mm, gas flows, at a high rate, into or out of the enclosed space 281 which is formed by the head cap 270. Therefore, it is difficult for the head cap 270 to keep the humidity of the enclosed space 281 in a proper range and ink starts to dry from the ink ejecting face 30*a*. If the slit width of the through-hole 271*a* is smaller than 0.05 mm, a working error may cause a situation that the head cap 270 allows gas to flow into or out of the enclosed space 281 only at a very low rate. This makes it difficult for the head cap 270 to cause the pressure within the enclosed space 281 to vary in link with the ambient pressure. A seal member may be stuck to the bottom surface of the plate member 271 so as to cover the outer opening of the through-hole 271*a*. The inner surface of the seal member is formed with a recess called "labyrinth" which has a very small cross section and forms a complex air passage. The enclosed space 281 communicates with the external space via the labyrinth. This structure makes it even easier to keep the humidity of the enclosed space 281 in a proper range. As a further alternative, holes of about 10 to 20 μm may be formed through a seal member by laser working so that the enclosed space 281 communicates with the outside environment via the holes.

Now, as in the description of the first embodiment, operations that are performed by the head cap 270 when an air pressure variation occurs in a state that the ink-jet head 2 is protected (transport state) will be described.

A description will be made of a case that the ink-jet head protection assembly 1 is transported by an airplane. After the airplane has taken off, a high-altitude air pressure is low and the pressure within the enclosed space 200 decreases together with the ambient air pressure due to passage of air through the recess 292*a* of the reservoir base plate 292. At this time, the pressure within the enclosed space 281 also decreases due to passage of air through the through-hole 271*a*. In this manner, the pressure within the enclosed space 200 becomes approximately equal to the pressure within the enclosed space 281. Therefore, the damper film 101 is not curved outward (i.e., away from the ink channel 96) and the ink menisci formed in the jets 8*a* do not receive pressure that exceeds their withstanding pressure. This prevents air bubbles from entering the channels.

On the other hand, after the airplane has landed, the ambient air pressure returns to atmospheric pressure from a low pressure and the pressure within the enclosed space 200 likewise returns to the original value. The pressure within the enclosed space 281 also returns to the original value from a low pressure due to passage of air through the through-hole 271*a*. In this manner, the pressure within the enclosed space 200 becomes approximately equal to the pressure within the enclosed space 281. Therefore, the damper film 101 is not curved toward the ink channel 96 and the ink menisci formed in the jets 8*a* do not receive pressure that exceeds their withstanding pressure. The ink menisci are not broken and the shipment liquid does not leak into the enclosed space 281.

As described above, in the ink-jet head protection assembly 1 according to this embodiment, since the enclosed space 200 communicates with the outside environment via the recess 292*a* of the reservoir base plate 292, the pressure within the enclosed space 200 varies so as to become approximately equal to the ambient air pressure. At this time, the pressure within the enclosed space 281 also varies due to passage of air through the through-hole 271*a* so as to become approximately equal to the ambient air pressure. Since no difference occurs between the pressure within the enclosed space 200 and the pressure within the enclosed space 281, the damper film 101 is not curved toward the ink channel 96 and the ink menisci in the jets 8*a* do not receive high pressure. Therefore, even if the ambient air pressure becomes higher than the pressure within the enclosed space 281, ink does not leak through jets 8*a*. Conversely, even if the ambient air pressure becomes low, no air bubbles enter the channels through jets 8*a*.

The preferred embodiments of the invention have been described above. However, the invention is not limited to those embodiments, and various modifications are possible without departing from the scope of the claims. For example, although in the first embodiment the top surface of the plate member 71 is formed with the two recesses 71*a* and the through-hole 71*b* penetrates through the bottom wall (plate member 71) of each recess 71*a*, a through-hole may be formed through a flat plate member without forming the two recesses 71*a*.

In the first embodiment, each film 72 is bonded to the portions close to the longer edges of the opening of the associated recess 71*a* and is not bonded to the portions close to the shorter edges of the opening of the associated recess 71*a*. A modification is possible in which each film 72 is bonded to the portions close to the shorter edges of the opening of the associated recess 71*a* and is not bonded to the portions close to the longer edges of the opening of the associated recess 71*a*. Another modification is possible in which each film 72 is bonded to portions close to most of the perimeter of the opening of the associated recess 71*a* and is not bonded to portions close to the remaining parts of the perimeter.

Although the lip 173 of the second embodiment is such that the two longer portions which expend parallel with the longitudinal direction of the plate member 171 serve as the first portion and the second portion, respectively, the two shorter portions which expend parallel with the shorter direction of the plate member 171 may serve as a first portion and a second portion, respectively. Another modification is possible in which the corner portion serve as first portions and second portions. Still another modification is possible in which parts of the two longer portions which expend parallel with the longitudinal direction of the plate member 171 or parts of the two shorter portions which expend parallel with the shorter direction of the plate member 171 serve as first portion(s) and second portion(s).

Figure 14:
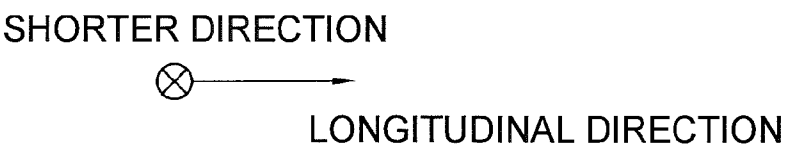
FIG. 14 shows a modification to the head cap according to the second embodiment of the invention.

In addition, whereas in the second embodiment the first portion and the second portion are defined by the angle formed by the inner side surface of the tip portion of the lip 173 and the perpendicular to the top surface of the plate member 171 and the angle formed by the outer side surface of the tip portion of the lip 173 and the perpendicular, respectively, as shown in FIG. 14 a first portion may be formed by a lip 274 and a support portion 276 which is lower than the lip 274 and adjacent to the right side surface of the lip 274 (as seen in FIG. 14). In this case, when the lip 274 falls outward, the bottom end of the lip 274 serves as a supporting point. When the lip falls inward, the portion of the lip 274 that contacts the top end of the support portion 276 serves as a supporting point. Therefore, the lip 274 is more apt to fall outward than inward. Furthermore, a second portion may be formed by a lip 275 and a support portion 277 which is lower than the lip 275 and adjacent to the right side surface of the lip 275 (as seen in FIG. 14). In this case, when the lip 275 falls inward, the bottom end of the lip 275 serves as a supporting point. When the lip falls outward, the portion of the lip 275 that contacts the top end of the support portion 277 serves as a supporting point. Therefore, the lip 275 is more apt to fall inward than outward. This modification provides the same advantages as the second embodiment.

Figure 15:
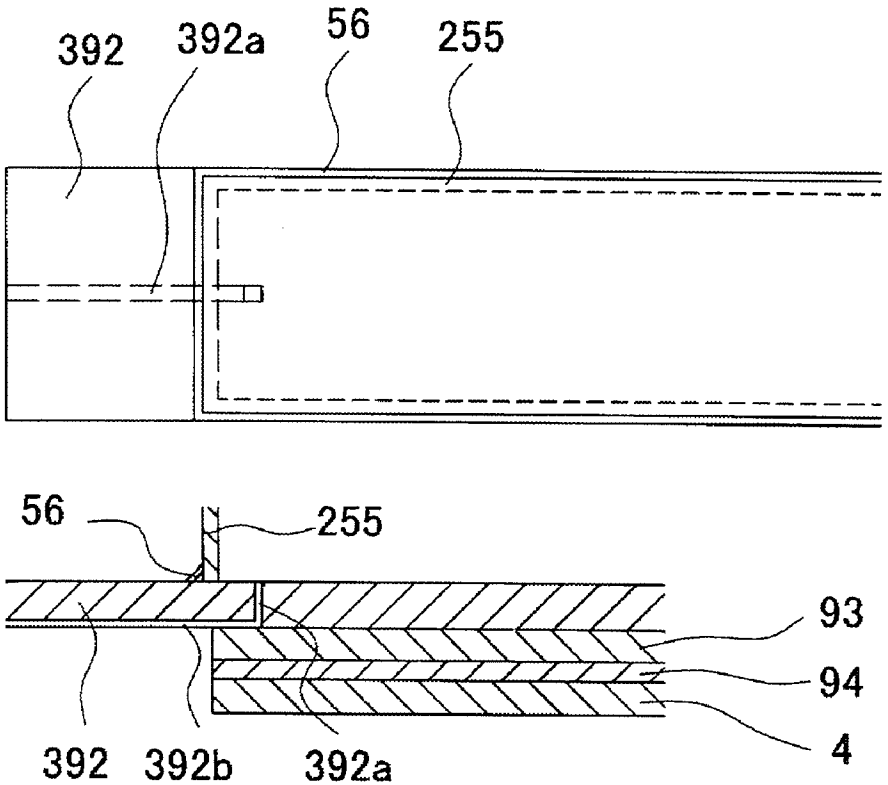
FIG. 15 shows a modification to the ink-jet head protection assembly according to the third embodiment of the invention.

In the third embodiment, the top surface of the reservoir base plate 292 is formed with the long recess 292*a* approximately at the center in the shorter direction in such a manner that it extends in the longitudinal direction and crosses the left-hand contact portion (as seen in FIG. 11) of the head cover 255 and the reservoir base plate 292. A modification is possible in which as shown in FIG. 15 a through-hole 392*a* penetrates through a reservoir base plate 392 and its opening in the top surface of the reservoir base plate 392 is located in the enclosed space 200. The bottom surface of the reservoir base plate 392 is formed with a long recess 392*b* which extends to the left end of the reservoir base plate 392. The through-hole 392*a* and the recess 392*b* communicate with each other. This modification provides the same advantages as the third embodiment.

The following provides various applications for one or more aspects of the present invention. In one aspect described above, the assembly may include a base member with a check valve and a cover with a lip. The lip deforms when the air pressure inside the enclosed space exceeds the ambient air pressure by a first threshold. The check valve opens when ambient air pressure exceeds the air pressure inside the enclosed space by a second threshold.

With this configuration, when the pressure outside the enclosed space has decreased, the lip may be configured to deform only if the air pressure within the enclosed space exceeds that outside the enclosed space by more than the first prescribed value. Therefore, the enclosed space communicates with the outside environment and gas flows out of the enclosed space, whereby the air pressure within the enclosed space at least starts to approach the ambient air pressure. On the other hand, even when the ambient air pressure has decreased, the base member is provided with the check valve. The check valve may be configured to open when the ambient air pressure exceeds that of the enclosed space by more than the second prescribed value. Therefore, when the ambient air pressure exceeds that of the enclosed space by more than the second prescribed value, the enclosed space communicates with the outside environment via the check valve and gas flows into the enclosed space. As a result, the ink menisci in the jets are less prone to receive high pressure and hence ink is prevented from leaking into the enclosed space through jets.

In some aspects, the one surface may be provided with a through-hole which allows the enclosed space to communicate with the outside environment and a film which covers the through-hole. The surface may be joined partially to a portion surrounding the through-hole. The check valve may be formed by the through-hole and the film. With this approach, the film is pushed by the external air when the air pressure outside the enclosed space has become higher than that of the enclosed space by more than the second prescribed value. At this time, since only part of the film may be joined to the one surface, external air can flow into the enclosed space through the portions where the film is not joined to the one surface. On the other hand, when the air pressure outside the enclosed space has decreased to such extent that the air pressure within the enclosed space becomes higher than that outside the enclosed space, the entire film which is opposed to the one surface is pressed against the one surface by the gas in the enclosed space. Since the film closes the through-hole to stop passage of gas, gas is prone to flow out of the enclosed space. The check value is formed with such a simple structure. The cap may also have a simple configuration.

The cap may be such that the one surface is formed with a recess having an opening, that the through-hole is formed through a bottom surface of the recess. The film may joined partially to a circumferential edge portion of the opening so as to cover the recess. Since the recess having a damper effect is formed in this manner, even when the temperature of the enclosed space has increased and the gas therein has expanded, the film is bent to prevent the ink menisci in the jets from being broken by the gas expansion. Therefore, gas is less prone to flow into the head from the enclosed space via jets.

Another aspect of the invention provides a cap for covering an ink ejecting face of an ink-jet head, where the ink-ejecting face is formed with jets through which ink droplets are ejected. The cap may include a base member opposed to the ink ejecting face. The cap may also include flexible, continuous lip projecting from one surface of the base member. The lip may or may not be ring shaped. When the lip is brought in contact with the ink ejecting face, an enclosed space is formed with the ink ejecting face being part of an inner wall surface of the enclosed space. Also, the lip may be provided with a first portion which is deformed so that the enclosed space communicates with the outside environment only when air pressure within the enclosed space exceeds that outside the enclosed space by more than a first prescribed value and a second portion which is deformed so that the enclosed space communicates with the outside environment only when the air pressure outside the enclosed space exceeds that of the enclosed space by more than a second prescribed value.

With this configuration, when the pressure outside the enclosed space has decreased, the first portion is deformed only if the air pressure within the enclosed space exceeds that outside the enclosed space by more than the first prescribed value. Therefore, the enclosed space communicates with the outside environment and gas flows out of the enclosed space, whereby the air pressure within the enclosed space approaches that outside the enclosed space. On the other hand, even when the pressure outside the enclosed space has decreased, the lip is provided with the second portion which is deformed only when the air pressure outside the enclosed space exceeds that of the enclosed space by more than the second prescribed value. Therefore, when the air pressure outside the enclosed space has become higher than that of the enclosed space by more than the second prescribed value, the enclosed space communicates with the outside environment and gas flows into the enclosed space. As a result, the ink menisci in the jets are less prone to receive high pressure and hence ink is prevented from leaking into the enclosed space through jets.

In one example, in the first portion, a tip portion of the lip may be tapered and an angle formed by an outer side surface of the tip portion and the perpendicular to the one surface be smaller than an angle formed by an inner side surface of the tip portion and the perpendicular; and that the enclosed space be formed in such a manner that the inner side surface of the tip portion of the first portion contacts the ink ejecting face. With this approach, the rigidity of the first portion is lower in the direction from the inner side surface to the outer side surface than in the direction from the outer side surface to the inner side surface. As such, the first portion is more apt to fall in the direction from the inner side surface to the outer side surface. Therefore, when the air pressure outside the enclosed space has become lower than that of the enclosed space, the first portion falls outward and is partly separated from the ink ejecting face, whereby the enclosed space communicates with the outside environment. This allows gas to flow out of the enclosed space reliably.

In the same or another example, in the second portion, a tip portion of the lip may be tapered and an angle formed by an outer side surface of the tip portion and the perpendicular to the one surface be larger than an angle formed by an inner side surface of the tip portion and the perpendicular. The enclosed space may be formed in such a manner that the outer side surface of the tip portion of the second portion contacts the ink ejecting face. With this approach, the rigidity of the second portion is lower in the direction from the outer side surface to the inner side surface than in the direction from the inner side surface to the outer side surface. As such, the second portion is more apt to fall in the direction from the outer side surface to the inner side surface. Therefore, when the air pressure outside the enclosed space has become higher than that of the enclosed space, the second portion falls inward and is partly separated from the ink ejecting face, whereby the enclosed space communicates with the outside environment. This allows external air to flow into the enclosed space reliably.

Optionally, the lip may be configured to have two longer portions which are parallel with a longitudinal direction of the base member. The longer portions may be the first portion and the second portion, respectively. This approach makes it easier to form the first portion and the second portion.

Still another aspect of the invention provides a cap for covering an ink ejecting face of an ink-jet head, with the ink-ejecting face being formed with jets through which ink droplets are ejected. The cap may include a base member opposed to the ink ejecting face; and a flexible, continuous lip projecting from one surface of the base member, wherein when the lip is brought in contact with the ink ejecting face, an enclosed space is formed with the ink ejecting face being part of an inner wall surface of the enclosed space; and at least one of the one surface and the lip is formed with a passage which allows the enclosed space to communicate with the outside environment. The lip may or may not be ring-shaped.

With this configuration, since the passage is provided which allows the enclosed space to communicate with the outside environment, no pressure difference occurs between the enclosed space and the outside environment. Therefore, the ink menisci in the jets are less prone to receive high pressure and hence ink is prevented from leaking into the enclosed space through jets.

In yet another aspect of the invention, the ink-jet head protection assembly may include any of the above-described caps that may be used with an ink-jet head including a channel unit which has first channels and in which an ink ejecting face is formed with jets through which ink droplets are ejected. The ink-jet head may include a reservoir unit which is fixed to a face, opposite to the ink ejecting face, of the channel unit and has a second channel which is formed so as to communicate with the first channels. The ink-jet head protection assembly may further include a cover member, which contacts surfaces of the channel unit and the reservoir unit, wherein an enclosed space is formed in the cover member because the cover member contacts the surfaces of the channel unit and the reservoir unit. In the enclosed space formed by the cover member, at least part of the second channel is formed by a flexible film. Also, at least one of the cover member and the reservoir unit is formed with a passage which allows the enclosed space formed by the cover member to communicate with the outside environment.

With this configuration, since the passage is provided which allows the enclosed space formed by the cover member to communicate with the outside environment, a pressure difference is less apt to occur between the enclosed space and the outside environment. That is, the air pressure within the enclosed space formed by the cover member varies in link with the ambient air pressure. At this time, the pressure in the cap also varies in link with the ambient air pressure. Therefore, the flexible film which is formed in the enclosed space formed by the cover member is less apt to be pushed toward the second channel side, and hence ink is prevented from leaking into the cap through jets.

The above description includes two prescribed values (two thresholds). In the above examples, the first and second prescribed values are the same (with respect to an air pressure difference between the air pressure of the outside environment and the air pressure inside the enclosed space). Alternatively, the first and second prescribed values may be different. It is appreciated that any prescribed value may be used to allow air to flow as based on the different environments where the ink-jet head may be transported, stored, and/or function. For instance, the first prescribed threshold may be set lower than the second value (35 kPa for the first value and 45 kPa for the second value) to allow air to flow out of the cap at a lower difference of air pressure. Here, this would allow higher air pressure inside the enclosed space to start flowing out at a lower pressure difference. This may bias the ink-jet head to experience less pressure pushing ink into the reservoir when moving to a lower air pressure environment and more pressure pushing ink into the enclosed space when moving to a higher air pressure environment. This may cause additional leakage when the ink-jet head is moved from a lower ambient air pressure environment to a higher ambient air pressure environment. However, it may be beneficial by preventing excess pressure inside the cap where the ink-jet head is to be used at a higher elevation.

In another example, the first prescribed threshold may be set higher than the second value (45 kPa for the first value and 35 kPa for the second value) to allow air to flow at a lower difference of air pressure. Here, this would allow higher air pressure outside the enclosed space to start flowing into the enclosed space at a lower pressure difference. This may bias the ink-jet head to experience more pressure pushing ink into the reservoir when moving to a lower air pressure environment and less pressure pushing ink into the enclosed space when moving to a higher air pressure environment. This may cause additional leakage when the ink-jet head is moved from a lower ambient air pressure environment to a higher ambient air pressure environment. This may help keep the ink from leaking into the enclosed space.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Numerous other embodiments, modifications and variations within the scope and spirit of the appended claims will occur to persons of ordinary skill in the art from a review of this disclosure.

What is claimed is:

1. A cap for covering an ink-ejecting face of an ink-jet head, the ink-ejecting face is formed with jets through which ink droplets are ejected, comprising:

a base member opposed to the ink ejecting face, the base member including a check valve; and a flexible, continuous lip projecting from one surface of the base member, the lip being configured to form an enclosed space when the lip is brought into contact with the ink ejecting face, the ink ejecting face being part of an inner wall surface of the enclosed space, the lip being further configured to deform so that the enclosed space communicates with the outside environment only when air pressure within the enclosed space exceeds that outside the enclosed space by more than a first prescribed value, and such that the check valve is opened only when the air pressure outside the enclosed space exceeds that of the enclosed space by more than a second prescribed value.

2. The cap according to claim 1, wherein:

the one surface is provided with a through-hole which allows the enclosed space to communicate with the outside environment and a film which covers the through-hole and is joined partially to a portion surrounding the through-hole; and the check valve is formed by the through-hole and the film.

3. The cap according to claim 2, wherein:

the one surface is formed with a recess having an opening;

the through-hole is formed through a bottom surface of the recess; and the film is joined partially to a circumferential edge portion of the opening so as to cover the recess.

4. The cap according to claim 1, wherein the first prescribed value is equal to the second prescribed value.

5. The cap according to claim 1, wherein the first prescribed value is different from the second prescribed value.

6. An ink-jet head protection assembly comprising:

the cap according to claim 1; and an ink-jet head including a channel unit which has first channels and in which an ink ejecting face is formed with jets through which ink droplets are ejected, a reservoir unit which is fixed to a face, opposite to the ink ejecting face, of the channel unit and has a second channel which communicates with the first channels, and a cover member which contacts surfaces of the channel unit and the reservoir unit, the cover member forming an enclosed space by contacting the surfaces of the channel unit and the reservoir unit, at least part of the second channel is formed by a flexible film in the enclosed space formed by the cover member, and such that at least one of the cover member and the reservoir unit is formed with a passage, which allows the enclosed space formed by the cover member to communicate with the outside environment.

* * * * *